US009452585B2

(12) United States Patent
Ota et al.

(10) Patent No.: US 9,452,585 B2
(45) Date of Patent: Sep. 27, 2016

(54) AUTOMATIC INSPECTION DEVICE FOR CORRUGATED PAPERBOARD MACHINE, AND CORRUGATED PAPERBOARD MACHINE

(71) Applicant: KABUSHIKI KAISHA ISOWA, Kasugai-shi, Aichi (JP)

(72) Inventors: Hiroshi Ota, Seto (JP); Michio Suzuki, Komaki (JP)

(73) Assignee: Kabushiki Kaisha Isowa, Aichi (JP)

( * ) Notice: Subject to any disclaimer, the term of this patent is extended or adjusted under 35 U.S.C. 154(b) by 604 days.

(21) Appl. No.: 13/847,102

(22) Filed: Mar. 19, 2013

(65) Prior Publication Data

US 2013/0260975 A1 Oct. 3, 2013

(30) Foreign Application Priority Data

Mar. 27, 2012 (JP) ..... 2012-072618

(51) Int. Cl.

| | |
|---|---|
| ***B31F 1/20*** | (2006.01) |
| ***B31F 7/00*** | (2006.01) |
| ***B31F 1/28*** | (2006.01) |
| *B31B 1/20* | (2006.01) |

(52) U.S. Cl.

CPC ..... *B31F 1/20* (2013.01); *B31F 1/2831* (2013.01); *B31F 7/00* (2013.01); *B31B 1/20* (2013.01)

(58) Field of Classification Search

CPC ..... B31F 1/20; B31F 1/00; B31F 1/2831; B31F 7/00

USPC ..... 493/31, 34, 51, 58, 59, 160, 463; 702/35, 81, 185; 83/498, 499, 504, 83/508.2, 508.3, 425.4; 700/108–109

See application file for complete search history.

(56) References Cited

U.S. PATENT DOCUMENTS

| | | | | |
|---|---|---|---|---|
| 6,098,022 A * | 8/2000 | Sonnichsen | G01M 13/028 | 702/190 |
| 6,143,112 A * | 11/2000 | Isowa | B31F 1/2831 | 156/205 |
| 6,947,864 B2 * | 9/2005 | Garnett | G01R 31/40 | 702/118 |
| 7,778,555 B2 * | 8/2010 | Shoji | G03G 15/55 | 399/9 |

(Continued)

FOREIGN PATENT DOCUMENTS

| | | |
|---|---|---|
| JP | 2003-001727 A | 1/2003 |
| JP | 2009-160797 A | 7/2009 |

(Continued)

*Primary Examiner* — Andrew M Tecco
*Assistant Examiner* — Valentin Neacsu
(74) *Attorney, Agent, or Firm* — Stroock & Stroock & Lavan LLP

(57) ABSTRACT

An automatic inspection device for a corrugated paperboard machine includes comprises a position setting section for setting movable members to positions within moving ranges; a control section for driving each of the drive motors at a given rotational speed so as to allow a respective one of the movable members to be moved within a corresponding one of the moving ranges; a current detection section for detecting a drive current being supplied to each of the drive motors when the drive motor is driven at the given rotational speed; and a current determination section for determining whether the drive current of each of the drive motors exceeds a given threshold. The automatic inspection device is configured to, when the current determination section determines that the drive current of a specific one of the plurality of drive motors exceeds the given threshold, detecting that a defect occurs in the movable member.

9 Claims, 10 Drawing Sheets

(56) References Cited

U.S. PATENT DOCUMENTS

| | | | | |
|---|---|---|---|---|
| 7,860,663 | B2 * | 12/2010 | Miyasaka | G01H 1/003 702/113 |
| 2004/0159693 | A1 * | 8/2004 | Adachi | B26D 5/02 225/3 |
| 2011/0173496 | A1 * | 7/2011 | Hosek | G05B 23/0235 714/26 |
| 2011/0268550 | A1 | 11/2011 | Kokubo et al. | |
| 2011/0295409 | A1 * | 12/2011 | Mierzejewski | B31D 5/0047 700/117 |

FOREIGN PATENT DOCUMENTS

| | | | | |
|---|---|---|---|---|
| JP | 2011-103049 | A | | 5/2011 |
| JP | 2011088393 | A | * | 5/2011 |
| JP | 2011103049 | A | * | 5/2011 |
| JP | 2011-230441 | A | | 11/2011 |

* cited by examiner

AUTOMATIC INSPECTION DEVICE FOR CORRUGATED PAPERBOARD MACHINE, AND CORRUGATED PAPERBOARD MACHINE

TECHNICAL FIELD

The present invention relates to an automatic inspection device for a corrugated paperboard machine, and a corrugated paperboard machine, and more particularly to an automatic inspection device for inspecting a defect of a tool moving mechanism adapted to move a machining tool for a corrugated paperboard sheet, or the like.

BACKGROUND ART

Heretofore, there has been proposed an inspection system for a corrugated paperboard machine, such as a corrugating machine for producing a corrugated paperboard, or a box making machine for making a corrugated box from a corrugated paperboard, wherein various sensors are provided in the corrugated paperboard machine, and a defect of the corrugated paperboard machine is identified based on detection signals from these sensors. For example, an inspection system described in JP 2011-103049A (Patent Document 1) is provided with various sensors, such as a speed detection sensor for detecting a conveyance speed of a corrugated paperboard sheet, a temperature detection sensor for detecting a temperature of each linerboard, a revolution number detection sensor for detecting a revolution number of a rotator, and a vibration detection sensor for detecting vibration around the rotator, in order to detect an operating state of a corrugated paperboard machine. Further, in regard to inspection for a region of a corrugated paperboard machine where it is difficult to install various sensors therein, a maintenance or inspection person first visually identifies a target region to be inspected, and then takes an image around the region or records an operating sound around the region, using a mobile inspection terminal. An information management unit is operable to receive, via a network, operation information such as detection signals, from the various sensors, and inspection information such as the taken image and the recorded sound, from the mobile inspection terminal. Then, the information management unit is operable to analyze the received operation and inspection information, for example, thereby identifying, as a defective component, a component having a high correlation with the operation information and the inspection information, or identifying, as a target adjusting section, an adjusting section having a high correlation with the operation information and the inspection information. The information management unit is operable to transmit, to the mobile inspection terminal, an instruction for replacing the defective component or an instruction for adjusting the target adjusting section. According to the instruction received by the mobile inspection terminal, the inspection person performs a maintenance work such as replacement or adjustment.

SUMMARY OF THE INVENTION

Technical Problem

In the inspection system described in the Patent Document 1, as to the region where it is difficult to install various sensors therein, a maintenance or inspection person identifies a target region through visual inspection, and perform operation, such as taking of an image around the target region, to acquire inspection information. For example, a region where it is difficult to install various sensors therein can include an area on which a paper powder generated during cutting of a corrugated paperboard scatters and accumulates. A phenomenon that such a paper powder scatters and accumulates is not limited to a station for cutting a corrugated paperboard, but the scattered paper powder is likely to reach an apparatus in a preceding or subsequent station, and accumulate on the apparatus. For example, a paper powder is likely to accumulate on an area of an apparatus for forming a folding line in a corrugated paperboard. Moreover, a paper powder adhering onto a corrugated paperboard being conveyed after the cutting is likely to scatter and accumulate in another station. Thus, in a corrugated paperboard machine, there widely exist a large number of areas on which a paper powder is likely to scatter and accumulate. In an area on which a paper powder is likely to scatter and accumulate, the paper powder exerts a negative influence on detection accuracy in the various sensors. Thus, in addition to inspecting the area where it is difficult to install the various sensors, the inspection person needs to inspect the various sensors in order to ensure detection accuracy by the various sensors.

Meanwhile, in a corrugated paperboard machine, a tool moving mechanism is employed which is adapted to move a tool, such as a machining tool for subjecting a corrugated paperboard to machining, e.g., cutting or formation of a folding line, or a handling tool for dividing a stack of corrugated paperboards into a plurality of batches, and position the tool at a given position. The tool moving mechanism comprises a plurality of movable members, such as a gear, a threaded shaft and a nut, adapted to be rotated by a drive motor, and moved while being in contact with another member. The above scattered paper powder is likely to accumulate and adhere on the movable member. If the paper powder adheres on the movable member, the tool moving mechanism cannot smoothly move the tool, such as the machining tool, toward a given position, which causes a problem in positioning of the tool.

For example, in order to detect a defect of a bearing, the inspection system described in the Patent Document 1 is operable to analyze a plurality of detection signals from the vibration detection sensor, the revolution number detection sensor and the temperature detection sensor to identify the bearing defect. For this purpose, it is necessary to install the plurality of sensors around the bearing. In this case, the inspection person inevitably needs to additionally inspect these sensors. In particular, installation of a plurality of sensors such as a vibration detection sensor and a temperature detection sensor, around each of a plurality of movable members of a tool moving mechanism for use in a corrugated paperboard machine, leads to an increase in workload of the inspection person. Moreover, it is difficult to install various sensors around each of a plurality of movable members of a tool moving mechanism for moving a tool used in a station having a large amount of scattered paper powder, such as a machining tool for cutting a corrugated paperboard, so that it is still necessary that the inspection person visually inspect the movable members.

In view of the above circumstances, it is therefore an object of the present invention to provide a corrugated paperboard machine automatic inspection device capable of inspecting a defect of a movable member which is provided in a tool moving mechanism for moving a tool such as a machining tool or a handling tool, and adapted to be driven by a drive motor, or a defect of a support member supporting the movable member, with a simple configuration.

Solution to the Technical Problem

In order to achieve the above object, according to a first aspect of the present invention, there is provided an automatic inspection device for a corrugated paperboard machine having a tool moving mechanism, wherein the tool moving mechanism comprises: a plurality of movable members each coupled to a respective one of a plurality of machining tools for subjecting a corrugated paperboard to machining; a support member movably supporting the plurality of movable members; and a plurality of drive motors for moving respective ones of the plurality of movable members along the support member. The automatic inspection device comprises: a position setting section for setting the plurality of movable members to positions located, respectively, within a plurality of moving ranges each defined along the support member correspondingly to a respective one of the plurality of movable members; a control section for driving each of the plurality of drive motors at a given rotational speed so as to allow a respective one of the plurality of movable members to be moved within a corresponding one of the plurality of moving ranges; a current detection section for detecting a drive current being supplied to each of the plurality of drive motors when the drive motor is driven at the given rotational speed by the control section; a current determination section for determining whether or not the drive current of each of the plurality of drive motors detected by the current detection section exceeds a given threshold; and a defect detection section for, when the current determination section determines that the drive current of a specific one of the plurality of drive motors exceeds the given threshold, detecting that a defect occurs in the movable member driven by the specific drive motor, or in a portion of the support member corresponding to the moving range of the movable member driven by the specific drive motor.

In the first aspect of the present invention, the machining tool may be any of a slitter blade for cutting a corrugated paperboard, a slotter blade for subjecting a corrugated paperboard to slotting, a scorer tool for forming a score line in a corrugated paperboard, and a creaser tool for forming a crease line in a corrugated paperboard.

In the first aspect of the present invention, as long as the movable member is a member adapted to be moved while being in contact with the support member, it may be configured to be engaged with the support member or may be configured to be slidingly moved on the support member.

In the first aspect of the present invention, the given threshold is determined based on a value of the drive current being supplied to the drive motor when a load exceeding an assumed load in design of the drive motor is applied to the drive motor. Generally, the assumed load in design of the drive motor is determined based on a value obtained by multiplying a rated torque value of the drive motor by a safety factor in design. Further, as long as the drive motor is driven within the assumed load in design of the drive motor, the given rotational speed may be equal to or greater than a rotational speed at which the drive motor is driven so as to allow the machining tool to be positioned and moved during machining of a corrugated paperboard (a rotational speed during the machining movement), or may be less than the rotational speed during the machining movement.

In the first aspect of the present invention, as long as each of the plurality of movable members is set to a position within a corresponding one of the plurality of moving ranges, the position setting section may be configured to set the movable member to any position within the moving range. The position setting section may be configured to set the plurality of movable members to the same positions within corresponding ones of the plurality of moving ranges, e.g., positions each adjacent to an end position of a respective one of the plurality of moving ranges, or may be configured to set the plurality of movable members, respectively, to different positions within corresponding ones of the plurality of moving ranges.

In the first aspect of the present invention, the automatic inspection device may be configured to, when the defect detection section detects that a defect occurs in the movable member driven by the specific drive motor whose drive current is determined to exceed the given threshold, by the current determination section, or in a portion of the support member corresponding to the moving range of the movable member driven by the specific drive motor, inform a maintenance or inspection person of the defective member, or perform a countermeasure, for example, automatically supply oil to the defective member.

In the first aspect of the present invention, the current detection section is operable to detect a drive current being supplied to each of the plurality of drive motors, and the current determination section is operable to determine whether or not the drive current detected by the current detection section exceeds the given threshold. Then, when the current determination section determines that the drive current of a specific one of the plurality of drive motors exceeds the given threshold, the defect detection section is operable to detect that a defect occurs in the movable member driven by the specific drive motor or in a portion of the support member corresponding to the moving range of the movable member driven by the specific drive motor. This makes it possible to inspect a defect of each of the movable members driven by the respective drive motors, and the support member, in the tool moving mechanism for moving tools such as machining tools or handling tools, with a simple configuration, without any need for installing a special sensor, such as a vibration detection sensor, around the movable member or the support member.

Preferably, the automatic inspection device according to the first aspect of the present invention further comprises a defect informing section for, when the defect detection section detects the defect, informing that a defect occurs in the movable member driven by the specific drive motor whose drive current is determined to exceed the given threshold, by the current determination section, or in a portion of the support member corresponding to the moving range of the movable member driven by the specific drive motor.

In the automatic inspection device having this feature, the defect informing section may be configured to display information specifying a defective member on a display unit, or may be configured to print out the information through a printing unit, or may be configured to output the information in an audio manner.

In the automatic inspection device having this feature, the defect informing section is operable to inform that a defect occurs in the movable member driven by the specific drive motor or in a portion of the support member corresponding to the moving range of the movable member driven by the specific drive motor. This makes it possible to allow an inspection person to readily know in which of the movable members the defect occurs, or in which of the moving ranges, i.e., in what portion of the support member, the defect occurs, thereby enhancing efficiency of inspection work.

Preferably, in the automatic inspection device according to the first aspect of the present invention, the plurality of moving ranges are defined along the support member in adjacent relation to each other, wherein the position setting section is operable to position each of the plurality of movable members at its initial position defined in a vicinity of an end position of a corresponding one of the plurality of moving ranges in a given direction along the support member, and the control section is operable to drive the plurality of the drive motors so as to allow the plurality of movable members to be moved individually from their initial positions in the same direction.

In the automatic inspection device having this feature, as long as there is not any non-moving range of the movable member, between adjacent ones of the moving ranges, the plurality of the moving ranges may be defined in such a manner that they are adjoined to each other, or overlapped with each other.

In the automatic inspection device having this feature, the plurality of moving ranges are defined along the support member in adjacent relation to each other. In this state, the control section is operable to drive the plurality of the drive motors so as to allow the plurality of movable members to be moved individually from their initial positions in the same direction. This makes it possible to move the plurality of movable members within corresponding ones of the moving ranges under the same condition, thereby accurately inspecting a state of each of the plurality of movable members or a state of a portion of the support member corresponding to each of the plurality of moving ranges.

Preferably, the automatic inspection device according to the first aspect of the present invention further comprises a current value storage section for, during a course where the plurality of movable members are moved individually from their initial positions in the same direction, sequentially storing a value of the drive current of each of the plurality of drive motors detected by the current detection section, in correlated relation with a position of the movable member moved by the drive motor.

In the automatic inspection device having this feature, during the course where the plurality of movable members are moved individually from their initial positions in the same direction, the current value storage section is operable to sequentially store a value of the drive current of each of the plurality of drive motors, in correlated relation with a position of the movable member moved by the drive motor. This makes it possible to readily find in which of the moving ranges of the plurality of movable members, i.e., in what portion of the support member, the defect occurs.

Preferably, the automatic inspection device according to the first aspect of the present invention further comprises a position informing section for, based on a content stored in the current value storage section, informing of at least a position of the movable member driven by a specific one of the plurality of drive motors when the drive current of the specific drive motor exceeds the given threshold.

In the automatic inspection device having this feature, the position informing section may be configured to inform of only a position of the movable member driven by a specific one of the plurality of drive motors when the drive current of the specific drive motor exceeds the given threshold, or may be configured to inform of a plurality of positions of each movable member in the entire moving range, and a plurality of values of the drive current detected at the positions.

In the automatic inspection device having this feature, the position informing section is operable, based on a content stored in the current value storage section, informing of at least a position of the movable member driven by a specific one of the plurality of drive motors when the drive current of the specific drive motor exceeds the given threshold. This makes it possible to allow an inspection person to readily know in which of the moving ranges of the plurality of movable members, i.e., in what portion of the support member, the defect occurs, thereby enhancing efficiency of inspection work.

Preferably, the automatic inspection device according to the first aspect of the present invention further comprises: an average value calculation section for calculating an average of values of the drive current detected by the current detection section during a course where each of the plurality of movable members is moved across an entirety of a corresponding one of the moving ranges; and an average value determination section for determining whether or not the average value calculated by the average value calculation section with regard to each of the plurality of drive motors exceeds a given average threshold, wherein the automatic inspection device is configured to, when the average value determination section determines that the average value of a specific one of the plurality of drive motors exceeds the given average threshold, detect that a defect occurs in the movable member driven by the specific drive motor.

In the automatic inspection device having this feature, the given average threshold is determined based on an average value of the drive current being supplied to the drive motor when a load exceeding an assumed load in design of the drive motor is continuously applied to the drive motor.

In the automatic inspection device having this feature, the average value calculation section is operable to calculate an average of values of the drive current detected by the current detection section. Then, when the average value determination section determines that the calculated average value of a specific one of the plurality of drive motors exceeds the given average threshold, it is detected that a defect occurs in the movable member driven by the specific drive motor. This makes it possible to accurately detect in which of the plurality of movable members the defect occurs.

Preferably, in the automatic inspection device according to the first aspect of the present invention, the current detection section is operable to perform the operation of detecting a drive current being supplied to each of the plurality of drive motors, at a plurality of different inspection timings; and the average value calculation section is operable to calculate an average of values of the drive current detected by the current detection section, at each of the plurality of different inspection timings, and wherein the automatic inspection device comprises: an average value storage section for time-serially storing the average values of the drive current calculated by the average value calculation section at the plurality of inspection timings; and a change rate determination section for determining whether or not a change rate between the average values time-serially stored in the average value storage section exceeds a given change rate, and wherein the automatic inspection device is configured to, when the change rate determination section determines that the change rate between the stored average values of a specific one of the plurality of the drive motors exceeds the given change rate, detect that a defect occurs in the movable member driven by the specific drive motor.

In the automatic inspection device having this feature, the change rate between the average values is an amount of change in the average value, per unit time period. Further, the given change rate is determined based on an amount of increase per unit time period, in the average value of the drive current being supplied to the drive motor when a large load equal to an assumed load in design of the drive motor is continuously applied to the drive motor.

In the automatic inspection device having this feature, the average value storage section is operable to time-serially store the average values of the drive current calculated by the average value calculation section. When the change rate between the stored average values of a specific one of the plurality of the drive motors exceeds a given change rate, it is detected that a defect occurs in the movable member driven by the specific drive motor. This makes it possible to promptly detect a defect of each of the movable members due to accumulation of a paper powder, a lack of lubrication or wear which progresses over time.

Preferably, in the automatic inspection device according to the first aspect of the present invention, each of the plurality of machining tools is a machining tool for cutting a corrugated paperboard, wherein the support member comprises a threaded shaft extending across a conveyance direction of the corrugated paperboard, and each of the plurality of movable members comprises a nut member threadingly engaged with the threaded shaft.

The automatic inspection device having this feature comprises: the plurality of movable members each coupled to a respective one of a plurality of machining tool for cutting a corrugated paperboard; the threaded shaft extending across the conveyance direction of the corrugated paperboard; and the plurality of nut members each threadingly engaged with the threaded shaft. This makes it possible to readily inspect the threaded shaft on which a large amount of paper powder generated during cutting is highly likely to accumulate, and the nut member on which the paper powder is highly likely to adhere.

Preferably, in the automatic inspection device according to the first aspect of the present invention, the controller is operable to drive each of the drive motors at the given rotational speed which is less than a rotational speed at which at least one of the plurality of drive motors is driven so as to allow each of the plurality of machining tools to be positioned and moved during machining of a corrugated paperboard.

In the automatic inspection device having this feature, the controller is operable to drive each of the drive motors at a rotational speed less than that at which at least one of the plurality of drive motors is driven so as to allow each of the plurality of machining tools to be positioned and moved during machining of a corrugated paperboard. This makes it possible to inspect a defect of each of the movable members or the support member without applying a large load to each of the drive motors.

According to a second aspect of the present invention, there is provided a corrugated paperboard machine having an automatic inspection function, which comprises: a plurality of machining tools for subjecting a corrugated paperboard to machining; a tool moving mechanism including a plurality of movable members each coupled to a respective one of the plurality of machining tools, a support member movably supporting the plurality of movable members, and a plurality of drive motors for moving respective ones of the plurality of movable members along the support member; a mode setting section for setting an inspection mode; a position setting section for, when the inspection mode is set, setting the plurality of movable members to positions located, respectively, within a plurality of moving ranges each defined along the support member correspondingly to a respective one of the plurality of movable members; a control section for, when the inspection mode is set, driving each of the plurality of drive motors at a given rotational speed so as to allow a respective one of the plurality of movable members to be moved within a corresponding one of the plurality of moving ranges; a current detection section for detecting a drive current being supplied to each of the plurality of drive motors when the drive motor is driven at the given rotational speed by the control section; a current determination section for determining whether or not the drive current of each of the plurality of drive motors detected by the current detection section exceeds a given threshold; and a defect detection section for, when the current determination section determines that the drive current of a specific one of the plurality of drive motors exceeds the given threshold, detecting that a defect occurs in the movable member driven by the specific drive motor or in a portion of the support member corresponding to the moving range of the movable member driven by the specific drive motor.

According to a third aspect of the present invention, there is provided an automatic inspection device for a corrugated paperboard machine having a plurality of tool moving mechanisms, wherein each of the tool moving mechanisms comprises: a movable member coupled to a tool for subjecting a corrugated paperboard to machining or operation; a support member movably supporting the movable member; and a drive motor for moving either one of the movable member and support member so as to move the movable member along the support member. The automatic inspection device comprises: a control section for driving each of the drive motors of the plurality of tool moving mechanisms, at a given rotational speed; a current detection section for detecting a drive current being supplied to each of the drive motors when the drive motor is driven at the given rotational speed by the control section; a current determination section for determining whether or not the drive current of each of the drive motors detected by the current detection section exceeds a given threshold; and a defect detection section for, when the current determination section determines that drive current of a specific one of the drive motors in the plurality of tool moving mechanisms exceeds the given threshold, detecting that a defect occurs in the movable member driven by the specific drive motor or in the support member supporting the movable member driven by the specific drive motor.

Each of the corrugated paperboard machine according to the second aspect of the present invention and the automatic inspection device according to the third aspect of the present invention may be variously embodied in the same manner as that in the first aspect of the present invention. In the third aspect of the present invention, the tool for subjecting a corrugated paperboard to operation is a member, such as a ledge for dividing a stack of corrugated paperboards into a plurality of batches, and a correction plate for aligning edges of a stack of corrugated paperboards.

DESCRIPTION OF EMBODIMENTS

Heretofore, a corrugating machine or a box making machine has been known as a corrugated paperboard machine. The corrugating machine is a corrugated paperboard machine for producing a corrugated paperboard and subjecting the corrugated paperboard to machining such as cutting and scoring, which is conventionally known, as disclosed, for example, in JP 2009-160797A. The box making machine is a corrugated paperboard machine for subjecting a corrugated paperboard to machining such as slotting and creasing and making a corrugated paperboard box, which is conventionally known, as disclosed, for example, in JP 2003-001727A and JP 2011-230441A. The corrugating machine is equipped with a slitter for cutting a corrugated paperboard, and a scorer for forming a score line perpendicular to a flute, in a corrugated paperboard. The box making machine is equipped with a slotter for subjecting a corrugated paperboard to slotting, a creaser for forming a crease line parallel to a flute, and a counter ejector for dividing a stack of machined corrugated paperboard sheets into a plurality of batches each consisting of a given number of the corrugated paperboard sheets. With reference to the accompanying drawings, one embodiment of the present invention will now be described, wherein the present invention is applied to a slitter as a part of a corrugating machine. In the following description, an up-down direction, a right-left direction and a front-rear direction are defined according to respective directions indicated by the arrowed lines in the figures.

General Configuration

Figure 1:
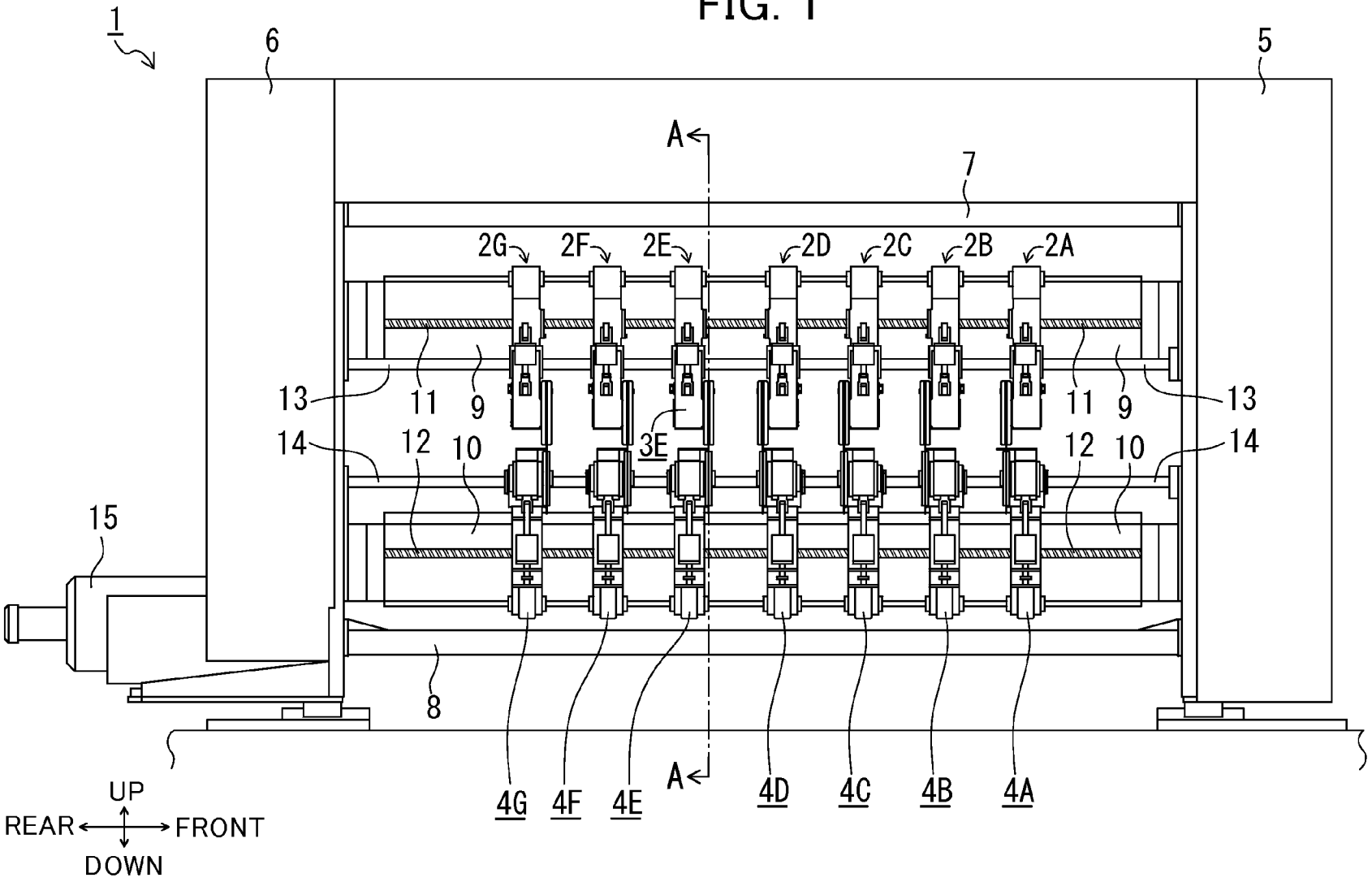
FIG. 1 is a left side view illustrating a general configuration of a slitter according to one embodiment of the present invention.

FIG. 1 is a left side view illustrating a general configuration of a slitter 1 according to one embodiment of the present invention. The slitter 1 is an apparatus for cutting a corrugated paperboard being conveyed, along a conveyance direction of the corrugated paperboard, and a configuration thereof is well known. In the slitter 1 according to this embodiment, seven slitter heads 2A to 2G are arranged side-by-side in a front-rear direction. Each of the slitter heads comprises a slitter blade receiver unit and a slitter blade unit. For example, the slitter head 2E has a slitter blade receiver unit 3E disposed on an upper side, and a slitter blade unit 4E disposed on a lower side.

In FIG. 1, the slitter 1 comprises a pair of frames 5, 6 opposed to each other in the front-rear direction. An upper beam 7 and a lower beam 8 are disposed between the frames 5, 6, individually. An upper guide member 9 and a lower guide member 10 are disposed between the frames 5, 6, individually. The upper guide member 9 is adapted to guide the seven slitter blade receiver units including the slitter blade receiver unit 3E, in a transverse direction, i.e., the front-rear direction. The lower guide member 10 is adapted to guide the seven slitter blade units including the slitter blade unit 4E, in the transverse (i.e., front-rear) direction. An upper threaded shaft 11 is disposed to extend in the front-rear direction and fixed to the upper guide member 9. A lower threaded shaft 12 is disposed to extend in the front-rear direction and fixed to the lower guide member 10. An upper rotational drive shaft 13 and a lower rotational drive shaft 14 are installed across the frames 5, 6, individually. A rotational drive motor 15 is fixed to the frame 6. Each of the rotational drive shafts 13, 14 is coupled to the rotational drive motor 15 via a driving force transmitting mechanism comprising a timing belt and a gear mechanism.

[Configuration of Slitter Head]

Figure 2:
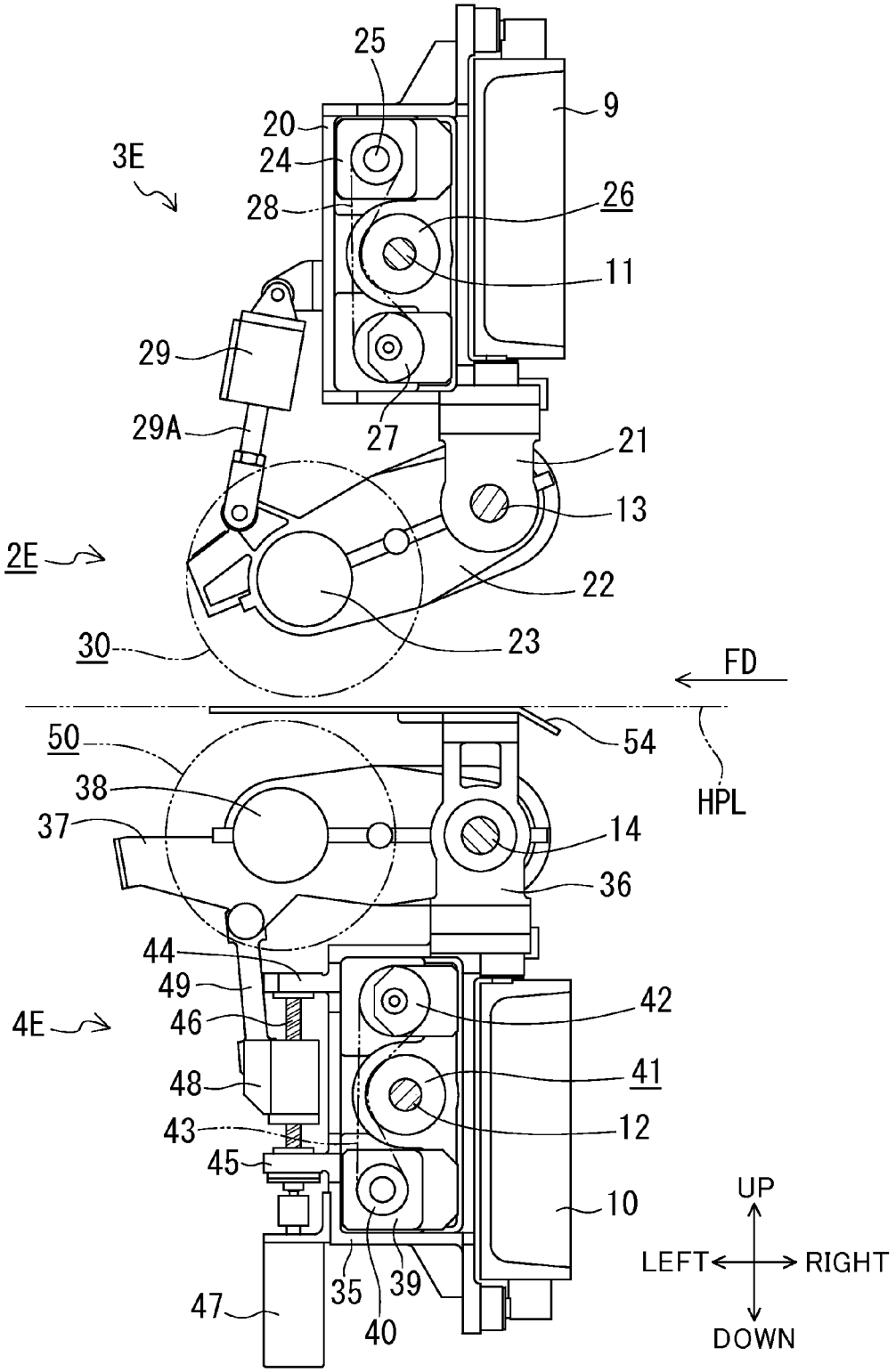
FIG. 2 is a sectional view enlargedly illustrating a configuration of a slitter head, taken along the alternate long and short dash line A-A in FIG. 1.

With reference to FIGS. 1 and 2, a configuration of each of the seven slitter heads 2A to 2G will be described. FIG. 2 is an enlarged sectional view taken along the alternate long and short dash line A-A in FIG. 1. In each of the slitter heads, the slitter blade receiver unit and the slitter blade unit are provided in such a manner as to be movable independently along respective ones of the guide members 9, 10, in the front-rear direction. Each of the slitter heads has the same configuration. Thus, the following description will be made by taking the slitter head 2E as a representative example.

(Configuration of Slitter Blade Receiver Unit 3E)

In FIG. 2, the slitter blade receiver unit 3E comprises a support block 20. The support block 20 is attached to the upper guide member 9 in a manner movable in the front-rear direction. An extension member 21 is fixed to a lower end of the support block 20. The upper rotational drive shaft 13 is penetratingly inserted into a through-hole formed in the extension member 21. A swing lever 22 is supported by the extension member 21 in a manner swingable about the upper rotational drive shaft 13. A rotary shaft 23 is rotatably supported by a distal end of the swing lever 22. The rotary shaft 23 is coupled to the upper rotational drive shaft 13 via a gear train.

A transverse movement servomotor 24 is fixed inside the support block 20. The transverse movement servomotor 24 is composed of a synchronous AC servomotor incorporating a position detector therein. A drive pulley 25 is fixed to an output shaft of the transverse movement servomotor 24. A rotatable member 26 is rotatably supported by the support block 20. The rotatable member 26 has a nut portion threadingly engaged with the upper threaded shaft 11, and a pulley portion. A driven pulley 27 is rotatably supported by the support block 20. A timing belt 28 is wound around the drive pulley 25, the pulley portion of the rotatable member 26 and the driven pulley 27 in a tensioned manner. Thus, according to a rotation of the transverse movement servomotor 24, the rotatable member 26 is rotated. Then, according to the rotation of the rotatable member 26, the support block 20 is moved in a front or rear direction depending on a rotational direction of the servomotor 24, by a transverse movement amount corresponding to a rotational amount of the servomotor 24.

An air cylinder 29 is swingably supported by a left wall of the support block 20. An actuation rod 29A of the air cylinder 29 is coupled to the distal end of the swing lever 22. A circular-shaped slitter blade receiver 30 is attached to the rotary shaft 23. When the actuation rod 29A of the air cylinder 29 is moved to a forward most position, the slitter blade receiver 30 is positioned at a load position where an outer periphery of the slitter blade receiver 30 is in contact with an upper surface of a corrugated paperboard being conveyed in the conveyance direction FD. On the other hand, when the actuation rod 29A of the air cylinder 29 is fully retracted, the slitter blade receiver 30 is positioned at an unload position where the outer periphery of the slitter blade receiver 30 is located in spaced-apart relation to an upper surface of a corrugated paperboard being conveyed in the conveyance direction FD.

(Configuration of Slitter Blade Unit 4E)

In FIG. 2, the slitter blade unit 4E comprises a support block 35. The support block 35 is attached to the lower guide member 10 in a manner movable in the front-rear direction. An extension member 36 is fixed to an upper end of the support block 35. The lower rotational drive shaft 14 is penetratingly inserted into a through-hole formed in the extension member 36. A swing lever 37 is supported by the extension member 36 in a manner swingable about the lower rotational drive shaft 14. A rotary shaft 38 is rotatably supported by an intermediate portion of the swing lever 37. The rotary shaft 38 is coupled to the lower rotational drive shaft 14 via a gear train.

A transverse movement servomotor 39 is fixed inside the support block 35. The transverse movement servomotor 39 is composed of a synchronous AC servomotor incorporating a position detector therein. A drive pulley 40 is fixed to an output shaft of the transverse movement servomotor 39. A rotatable member 41 is rotatably supported by the support block 35. The rotatable member 41 has an after mentioned nut portion threadingly engaged with the lower threaded shaft 12, and an after mentioned pulley portion. A driven pulley 42 is rotatably supported by the support block 35. A timing belt 43 is wound around the drive pulley 40, the pulley portion of the rotatable member 41 and the driven pulley 42 in a tensioned manner. Thus, according to a rotation of the transverse movement servomotor 39, the rotatable member 41 is rotated. Then, according to the rotation of the rotatable member 41, the support block 35 is moved in a front or rear direction depending on a rotational direction of the servomotor 39, by a transverse movement amount corresponding to a rotational amount of the servomotor 39.

A pair of support protrusions 44, 45 are formed on a left wall of the support block 35. A vertical threaded shaft 46 is disposed to extend in an up-down direction, and rotatably supported by the support protrusions 44, 45. An up-down movement servomotor 47 is fixed to a lower end of the support block 35. The up-down movement servomotor 47 is composed of a synchronous AC servomotor incorporating a position detector therein. An output shaft of the up-down movement servomotor 47 is coupled to the vertical threaded shaft 46. An up-down movable member 48 has a nut portion threadingly engaged with the vertical threaded shaft 46. A coupling rod 49 couples the up-down movable member 48 and the intermediate portion of the swing lever 37 together.

A slitter blade 50 is attached to the rotary shaft 38. According to a rotation of the up-down movement servomotor 47, the up-down movable member 48 is moved in the up-down direction. Then, according to the movement of the up-down movable member 48, the swing lever 37 is swingingly moved in an up or down direction depending on a rotational direction of the servomotor 47, by an angle corresponding to a rotational amount of the servomotor 47. In this way, an amount of engagement between the slitter blade 50 and the slitter blade receiver 30 is adjusted.

In FIG. 2, a support plate 54 is fixed to an upper end of the extension member 36 to support a corrugated paperboard being conveyed in the conveyance direction FD. The support plate 54 is formed to extend in a right-left direction so as to come into contact with a lower surface of the corrugated paperboard. In this embodiment, a position of an upper surface of the support plate 54 in the up-down direction is a paper line position HPL which is a position of a lower surface of a corrugated paperboard being conveyed.

(Detailed Configuration of Rotatable Member 41)

Figure 3:
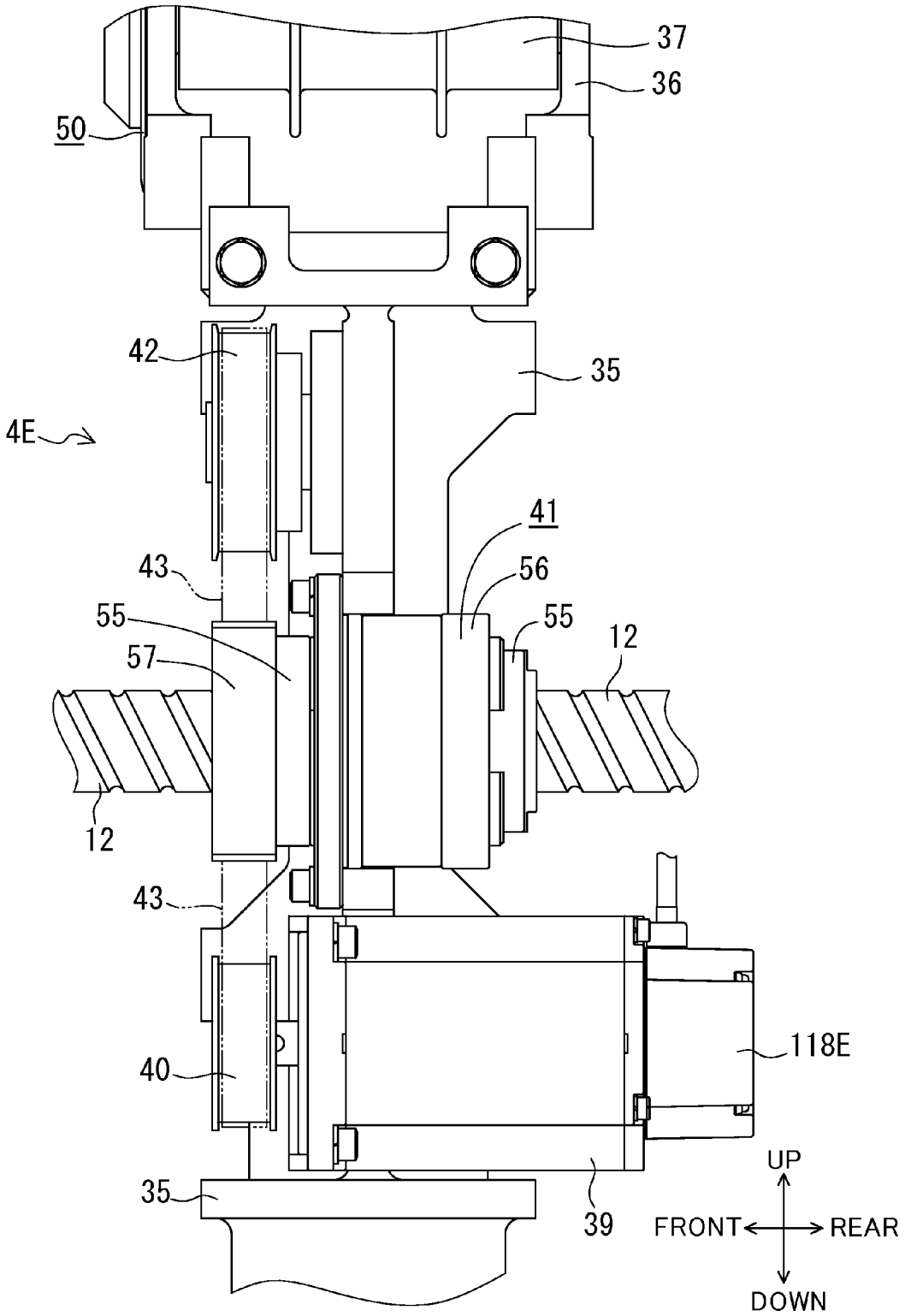
FIG. 3 is a right side view enlargedly illustrating an inside of a support block of a slitter blade unit.

The configuration of the rotatable member 41 is the same as that of the rotatable member 26. Thus, the following description will be made with reference to FIG. 3 by taking configuration of the rotatable member 41 as a representative example. FIG. 3 is a right side view enlargedly illustrating an inside of the support block 35 of the slitter blade unit 4E. In FIG. 3, the rotatable member 41 has a nut portion 55, an annular fixing portion 56 and a pulley portion 57. The nut portion 55 is threadingly engaged with the lower threaded shaft 12. The annular fixing portion 56 is fixed to the support block 35, while rotatably supporting the nut portion 55 through a bearing. The pulley portion 57 is fixed to the nut portion 55, and adapted to be rotated integrally together with the nut portion 55. The rotation of the transverse movement servomotor 39 is transmitted from the drive pulley 40 to the pulley portion 57 via the timing belt 43. Thus, the nut portion 55 is rotated together with the pulley portion 57, and moved in the front-rear direction along the lower threaded shaft 12 threadingly engaged therewith. According to the movement of the nut portion 55, the support block 35 to which the annular fixing portion 56 is fixed is moved in the front-rear direction. That is, the slitter blade 50 is moved in the transverse (i.e., front-rear) direction.

[Electrical Configuration]

Figure 4:
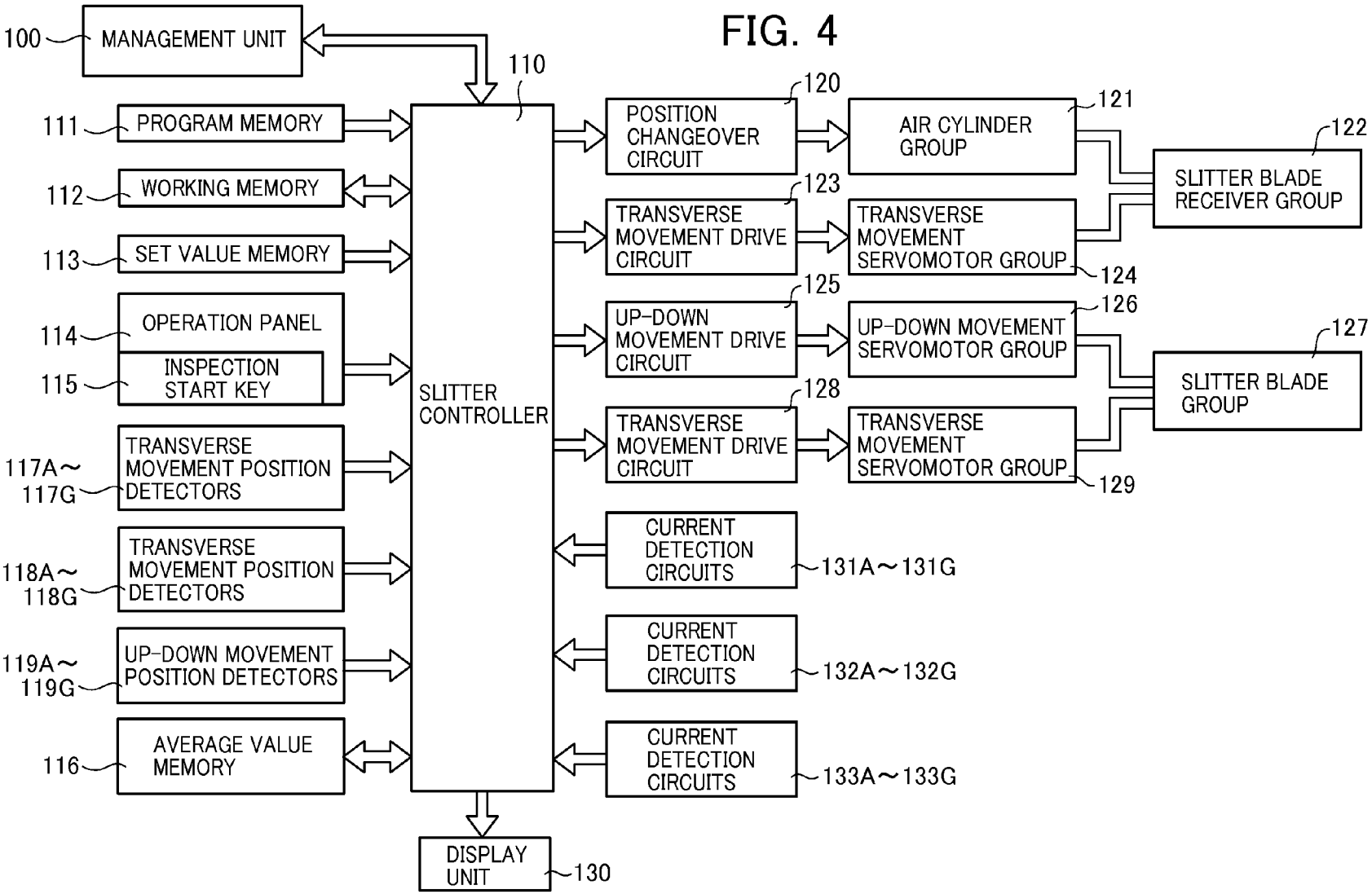
FIG. 4 is a block diagram illustrating an electrical configuration of the slitter.

With reference to FIG. 4, an electrical configuration of the slitter 1 according to this embodiment will be described. FIG. 4 is a block diagram illustrating the electrical configuration of the slitter 1. In FIG. 4, a management unit 100 is configured to manage an operation of the entire corrugating machine including the slitter 1. A slitter controller 110 is connected to the management unit 100 so as to perform a control operation according to an instruction from the management unit 100, and notify the management unit 100 of a current control state. The slitter controller 110 is configured to control a machining operation of cutting a corrugated paperboard by the slitter 1, a transverse movement inspection operation of inspecting a transverse movement of the slitter blade receiver units and the slitter blade units, and an up-down movement inspection operation of inspecting an up-down movement of the slitter blade units.

A program memory 111 fixedly stores therein a machining control program for controlling a machining operation of the slitter 1, a slitter blade receiver unit-related transverse movement inspection control program, a slitter blade unit-related transverse movement inspection control program, a change rate determination program, and an up-down movement inspection control program. The slitter blade unit-related transverse movement inspection control program is a program for executing a transverse movement inspection process illustrated in FIG. 6. The change rate determination program is a program for executing a change rate determination process illustrated in FIG. 8. The slitter blade-related up-down movement inspection control program is a program for executing an up-down movement inspection process illustrated in FIG. 10. A working memory 112 is configured to temporarily store therein control instructions and a variety of other information, and temporarily store therein a result of execution of a control program. A set value memory 113 fixedly stores therein various predetermined set values.

Assuming that the up-down movable member 48 is moved upwardly until an uppermost edge of slitter blade 50 attached to the rotary shaft 38 reaches a position located below the paper line position HPL illustrated in FIG. 2 by a given distance, an up-down movement position of the up-down movable member 48 in this state is a standby up-down movement position HU corresponding to an unload position of the slitter blade 50. The standby up-down movement position HU is fixedly stored in the set value memory 113 as a set value. The up-down movement position HS of the up-down movable member 48 is a position to be measured on the basis of the standby up-down movement position HU.

As a set value, set values for use in the transverse movement inspection process and the up-down movement inspection process are also fixedly stored in the set value memory 113. For example, as a set value for use in the slitter blade unit-related transverse movement inspection process, a threshold SHP and average threshold SHA concerning a drive current for a transverse movement servomotor such as the transverse movement servomotor 39, a given change rate DCA concerning a change rate between average drive current values CA, front end positions FPA to FPG and rear end positions BPA to BPG defined along the lower threaded shaft 12, are fixedly stored. As with the above set values for use in the slitter blade unit-related transverse movement inspection process, a set value for use in a slitter blade receiver unit-related transverse movement inspection process is also fixedly stored. As a set value for use in the slitter blade-related up-down movement inspection process, a threshold concerning a drive current for an up-down movement servomotor such as the up-down movement servomotor 47, and an upper end position and a lower end position each defining a respective one of an upper end and a lower end of an overall moving range within which the up-down movable member 48 can be moved along the vertical threaded shaft 46, are fixedly stored.

Figure 5:
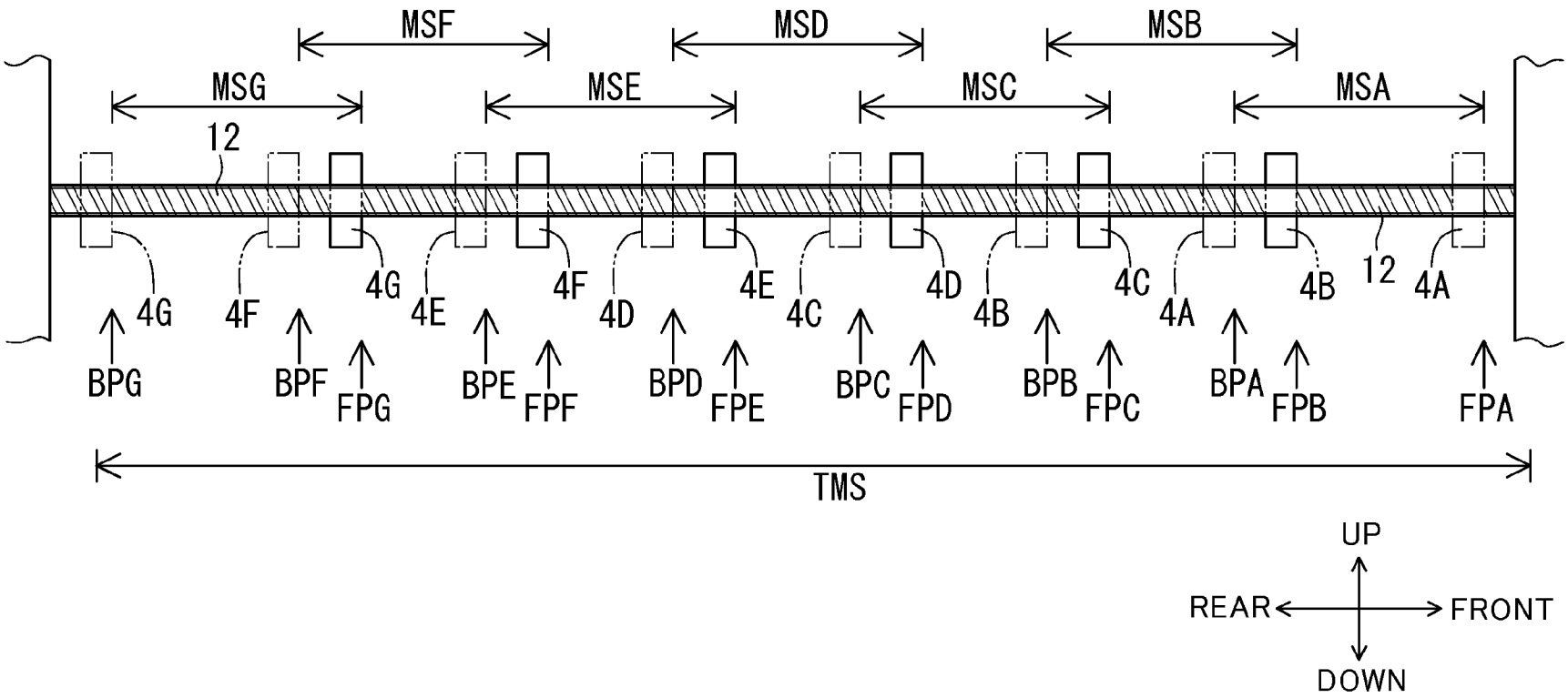
FIG. 5 is an explanatory diagram illustrating an operation of moving seven slitter blade units along a lower threaded shaft in a transverse (i.e., front-rear) direction, in a transverse movement inspection process.

Details of the front end positions FPA to FPG and the rear end positions BPA to BPG each defined along the lower threaded shaft 12 will be described with reference to FIG. 5. FIG. 5 is an explanatory diagram illustrating an operation of moving the seven slitter blade units 4A to 4G along the lower threaded shaft 12 in the transverse (i.e., front-rear) direction, in the transverse movement inspection process. In FIG. 5, an overall moving range TMS defined along the lower threaded shaft 12 is a range within which any of the seven slitter blade units 4A to 4G can be moved along the lower threaded shaft 12. Each of seven moving ranges MSA to MSG is a range defined along the lower threaded shaft 12 correspondingly to a respective one of the seven slitter blade units 4A to 4G. The seven front end positions FPA to FPG and the seven rear end positions BPA to BPG specify front ends and rear ends of the seven moving ranges MSA to MSG; respectively. In the transverse movement inspection process, each of the seven slitter blade units is reciprocatingly moved within a corresponding one of the moving ranges. Each of the moving ranges is defined to have an overlapping region with an adjacent one of the remaining moving ranges. For example, the moving range MSA overlaps the moving range MSB in a rear end region thereof. The moving range MSC overlaps the moving range MSB and the moving range MSD in a front region and a rear end region thereof, respectively. The moving range MSG overlaps the moving range MSF in a front end region thereof In the slitter blade-related up-down movement inspection process, when the up-down movable member is reciprocatingly moved between the upper end position and the lower end position along the vertical threaded shaft, the up-down movement servomotor is rotated at a given up-down movement rotational speed. The given up-down movement rotational speed is fixedly stored in the set value memory 113 as a set value. The given up-down movement rotational speed is a rotational speed less than that of the up-down movement servomotor during an operation of moving the slitter blade between a position engageable with the slitter blade receiver and the unload position, so as to allow the slitter blade to cut a corrugated paperboard. This prevents a load greater than that during the cutting from being imposed on the up-down movement servomotor in the up-down movement inspection process. Further, in the slitter blade receiver unit-related and slitter blade unit-related transverse movement inspection processes, when the rotatable member in each unit is reciprocatingly moved between the front end position and the rear end position along the threaded shaft, each of the transverse movement servomotors is rotated at a given transverse movement rotational speed. The given transverse movement rotational speed is fixedly stored in the set value memory 113 as a set value. The given transverse movement rotational speed is a rotational speed less than that of each of the transverse movement servomotors during an operation of moving a respective one of the units to a given machining position in the transverse direction, so as to allow the slitter blade receiver and the slitter blade to cut a corrugated paperboard. This prevents a load greater than that during the transverse movement toward the machining position from being imposed on the transverse movement servomotor in the transverse movement inspection process.

Returning to FIG. 4, an operation panel 114 is provided to input various instructions into the slitter controller 110. The operation panel 114 has an inspection start key 115 for starting the inspection process.

A group of slitter blade receiver unit-related transverse movement position detectors 117A to 117G are connected to the slitter controller 110, and provided to detect respective transverse movement positions (i.e., positions in the front-rear direction) of the seven slitter blade receiver units in the seven slitter heads 2A to 2G. The group of transverse movement position detectors 117A to 117G are composed of seven position detectors incorporated in respective ones of the seven transverse movement servomotors including the transverse movement servomotor 24. A group of slitter blade unit-related transverse movement position detectors 118A to 118G are connected to the slitter controller 110, and provided to detect respective transverse movement positions (i.e., positions in the front-rear direction) of the seven slitter blade units in the seven slitter heads 2A to 2G. The group of transverse movement position detectors 118A to 118G are composed of seven position detectors incorporated in respective ones of the seven transverse movement servomotors including the transverse movement servomotor 39. For example, as illustrated in FIG. 3, in the slitter blade unit 4E, a position detector 118E is provided in the transverse movement servomotor 39. A group of up-down movement position detectors 119A to 119G are connected to the slitter controller 110, and provided to detect respective up-down movement positions (i.e., positions in the up-down direction) of the seven up-down movable members in the seven slitter blade units. The group of up-down movement position detectors 119A to 119G are composed of seven position detectors incorporated in respective ones of the seven up-down movement servomotors including the up-down movement servomotor 47.

An average value memory 116 is adapted to fixedly store therein an average value of a drive current of each of the servomotors, when the transverse movement inspection process and the up-down movement inspection process are executed. The average value memory 116 is composed of an electronically rewritable nonvolatile memory. The transverse movement inspection process and the up-down movement inspection process are executed on a periodic basis. Thus, the average value memory 116 time-serially stores therein an average value calculated during execution of each of a plurality of inspection process cycles. In this embodiment, each of the inspection processes is executed on a monthly basis.

A position changeover circuit 120 is connected to the slitter controller 110 to control an operation of each of the seven air cylinders in the seven slitter blade receiver units, according to an instruction from the slitter controller 110. In FIG. 4, the seven air cylinders including the air cylinder 29 are indicated as an air cylinder group 121, and the seven slitter blade receivers including the slitter blade receiver 30 are indicated as a slitter blade receiver group 122. The slitter blade receiver unit-related transverse movement drive circuit 123 is connected to the slitter controller 110 to control the rotation direction, the rotational amount and the rotational speed of each of the seven transverse movement servomotors, according to an instruction from the slitter controller 110. In FIG. 4, the seven transverse movement servomotors including the transverse movement servomotor 24 are indicated as a transverse movement servomotor group 124.

An up-down movement drive circuit 125 is connected to the slitter controller 110 to control the rotation direction, the rotational amount and the rotational speed of each of the seven up-down movement servomotors, according to an instruction from the slitter controller 110. In FIG. 4, the seven up-down movement servomotors including the up-down movement servomotor 47 are indicated as an up-down movement servomotor group 126, and the seven slitter blades including the slitter blade 50 are indicated as a slitter blade group 127. A slitter blade unit-related transverse movement drive circuit 128 is connected to the slitter controller 110 to control the rotation direction, the rotational amount and the rotational speed of each of the seven transverse movement servomotors, according to an instruction from the slitter controller 110. In FIG. 4, the seven transverse movement servomotors including the transverse movement servomotor 39 are indicated as a transverse movement servomotor group 129.

A display unit 130 is connected to the slitter controller 110, and provided to display information input from the operation panel 114 and a variety of other information such as an error message, according to an instruction from the slitter controller 110.

A group of current detection circuits 131A to 131G are connected to the slitter controller 110, and provided to detect respective drive currents of the seven transverse movement servomotors in the seven slitter blade receiver units. Each of the current detection circuits 131A to 131G is a circuit for detecting a drive current being supplied from the slitter blade receiver unit-related transverse movement drive circuit 123, to a respective one of the seven transverse movement servomotors in the transverse movement servomotor group 124. A group of current detection circuits 132A to 132G are connected to the slitter controller 110, and provided to detect respective drive currents of the seven up-down movement servomotors in the seven slitter blade units. Each of the current detection circuits 132A to 132G is a circuit for detecting a drive current being supplied from the slitter blade-related up-down movement drive circuit 125, to a respective one of the seven up-down movement servomotors in the up-down movement servomotor group 126. A group of current detection circuits 133A to 133G are connected to the slitter controller 110, and provided to detect respective drive currents of the seven transverse movement servomotors in the seven slitter blade units. Each of the current detection circuits 133A to 133G is a circuit for detecting a drive current being supplied from the slitter blade unit-related transverse movement drive circuit 128 to a respective one of the seven transverse movement servomotors in the transverse movement servomotor group 129.

For example, the current detection circuit 131E of the transverse movement servomotor 24 comprises a voltage-dividing resistor connected to an output side of a servo-amplifier provided in the transverse movement drive circuit 123 for supplying a drive current to the transverse movement servomotor 24. The current detection circuit 131E is operable to detect a voltage divided by the voltage-dividing resistor, thereby detecting the drive current of the transverse movement servomotor 24. Each of the current detection circuits 132A to 132G and the current detection circuits 133A to 133G has the same configuration as that of the current detection circuit 131E.

Operation of this Embodiment

An operation of the slitter 1 according to this embodiment will be described below. An operation of cutting a corrugated paperboard by the slitter 1 is conventionally known, as disclosed, for example, in JP 3717167B and JP 2011-088393A. Thus, only an operation of inspecting the slitter 1 by each member being moved along the threaded shaft will be described below. In particular, considering that the slitter blade receiver unit-related transverse movement inspection process and the slitter blade unit-related transverse movement inspection process are approximately the same process, the following description will be made by taking the slitter blade unit-related transverse movement inspection process as a representative example and with reference to FIG. 6.

(Slitter Blade Unit-Related Transverse Movement Inspection Process)

Figure 6:
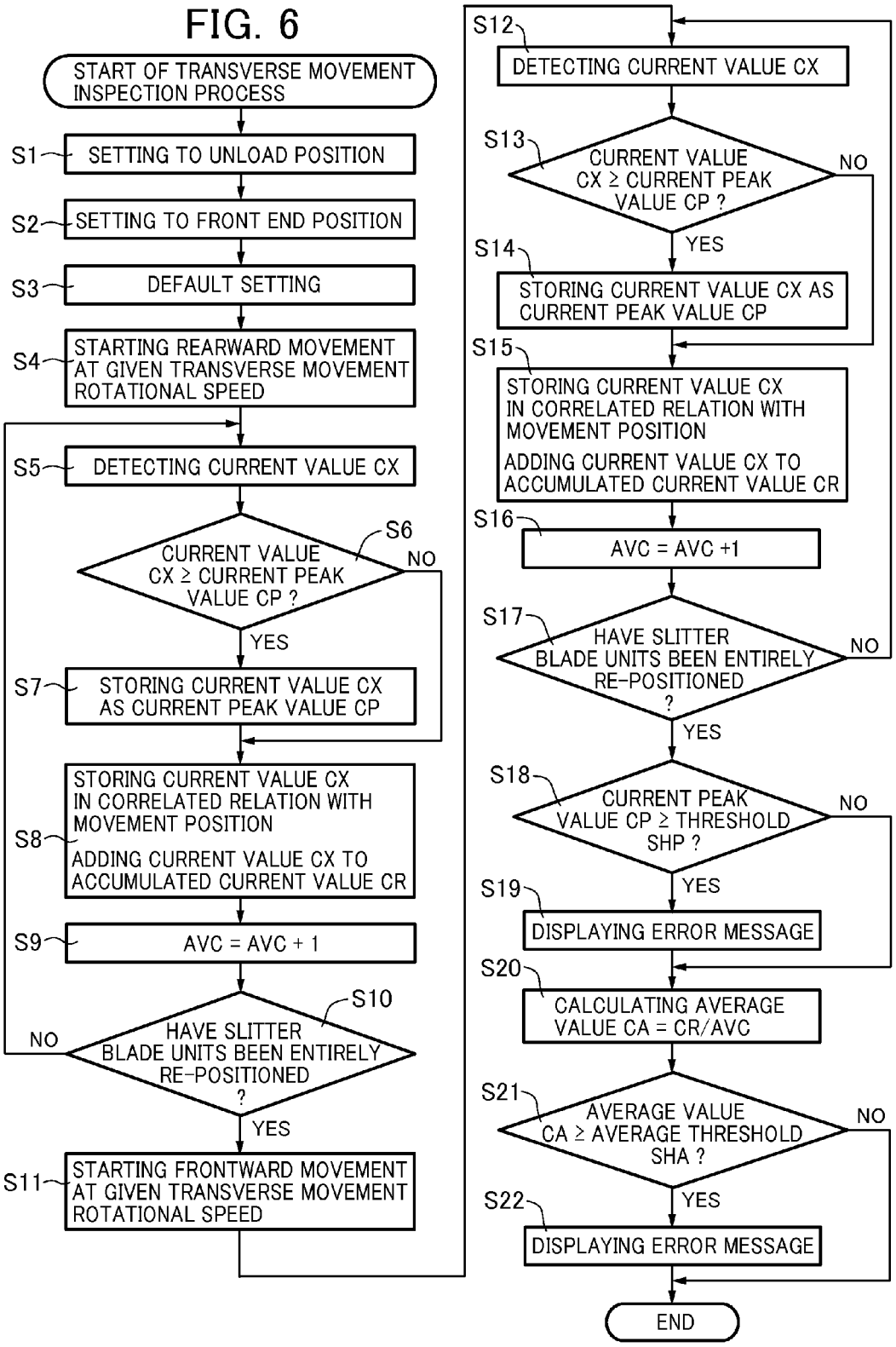
FIG. 6 is a flowchart illustrating the slitter transverse movement inspection process.

In order to execute the transverse movement inspection process for the seven slitter blade units 4A to 4G, an inspection person manipulates the operation panel 114 so as to select a slitter blade unit transverse movement inspection mode. Then, the inspection person manipulates the inspection start key 115. In response to detecting the manipulation of the inspection start key 115, the slitter controller 110 stores the selected inspection mode in the working memory 112 and sets an operation mode to the inspection mode. When the inspection mode is set, the slitter controller 110 starts to run the slitter blade unit-related transverse movement inspection control program stored in program memory 111. After termination of the execution of the slitter blade unit-related transverse movement inspection control program, the slitter controller 110 releases the inspection mode. During execution of the inspection mode, the slitter controller 110 inhibits an operation of manually moving the slitter blade receiver units and the slitter blade units. Along with the execution of the slitter blade unit-related transverse movement inspection control program, the process illustrated in FIG. 6 will be executed. The process illustrated in FIG. 6 is executed by the slitter controller 110.

In Step S1, the seven slitter blade units 4A to 4G are positioned at the unload position. Specifically, based on a detection result of the up-down movement position detectors 119A to 119G, the seven up-down movable members including the up-down movable member 48 are moved and positioned at the predefined standby up-down movement position HU, by the up-down movement servomotor group 126 including the up-down movement servomotor 47. In this way, each of the seven slitter blades including the slitter blade 50 is positioned at the unload position.

In Step S2, the seven slitter blade units 4A to 4G are positioned at the seven front end positions FPA to FPG, respectively. Specifically, based on a detection result of the slitter blade unit-related transverse movement position detectors 118A to 118G, the seven rotatable members including the rotatable member 41 are moved and positioned at respective ones of the front end positions FPA to FPG illustrated in FIG. 5, by the transverse movement servomotor group 129 including the transverse movement servomotor 39.

In Step S3, a default setting is executed. Specifically, a variety of memory information such as a current peak value CP, an accumulated current value CR and a detection cycle count value AVC, stored in respective storage areas of the working memory 112, is cleared. The current peak value CP and the accumulated current value CR are stored with respect to each servomotor in the transverse movement servomotor group 129.

In Step S4, the transverse movement servomotor group 129 starts to move the slitter blade units 4A to 4G rearwardly from respective ones of the front end positions FPA to FPG. In this step, the transverse movement servomotor group 129 is rotated at the given transverse movement rotational speed stored in the set value memory 113.

At Step S5, each of the current detection circuits 133A to 133G detects a drive current value CX, i.e., a value of a drive current being supplied to a respective one of the servomotors in the transverse movement servomotor group 129 during the rearward movement of the slitter blade units 4A to 4G.

In Step S6, with respect to each servomotor in the transverse movement servomotor group 129, it is determined whether or not the detected drive current value CX is equal to or greater than the current peak value CP. In the Step S3, the current peak value CP has been cleared. Thus, in the Step S6, the current value CX is determined to be equal to or greater than the current peak value CP (S6: YES), and the process advances to Step S7.

In the Step S7, with respect to each transverse movement servomotor, the detected drive current value CX is stored in the working memory 112 as an updated current peak value CP.

In Step S8, with respect to each transverse movement servomotor, the detected drive current value CX is stored in correlated relation with a corresponding one of the front end positions. For example, as to the transverse movement servomotor 39 of the slitter blade unit 4E, the current value CX is stored in the working memory 112 in correlated relation with the front end position FPA. Further, the current value CX is added to the accumulated current value CR, and a resulting accumulated current value CR is stored in the working memory 112.

In Step S9, the detection cycle count value AVC is incremented by "1". In the Step S3, the detection cycle count value AVC has been cleared. Thus, in the Step S9, the detection cycle count value AVC is incremented from "0" to "1".

In Step S10, based on a detection result of the transverse movement position detectors 118A to 118G, it is determined whether or not the seven slitter blade units 4A to 4G have been re-positioned at respective ones of the rear end positions BPA to BPG illustrated in FIG. 5. When it is determined that the slitter blade units 4A to 4G have not been entirely re-positioned (S10: NO), the process returns to the Step S5 to execute the processing in the Step S5 again. When it is determined that the slitter blade units 4A to 4G have been entirely re-positioned (S10: YES), the process advances to the Step S11.

In the case where processing in the Step S5 is executed again as mentioned above, with respect to each transverse movement servomotor, a value CX of the drive current is detected every time the slitter blade units is moved by a given distance. In this embodiment, a value CX of the drive current is detected every time each of the slitter blade units is moved by a given distance of 10 mm. Then, in the Step S6, it is determined whether or not the detected drive current value CX is equal to or greater than the current peak value CP. When the current value CX is determined to be not equal to or greater than the current peak value CP (S6: NO), the process skips to the Step S8. On the other hand, when the current value CX is determined to be equal to or greater than the current peak value CP (S6: YES), the process advances to the Step S7 to execute processing in Step S7 in the same manner as mentioned above.

In the Step S8, the current value CX is stored in the working memory 112 in correlated relation with a position displaced rearwardly from the front end position by 10 mm. Further, the current value CX is added to the accumulated current value CR, and a resulting accumulated current value CR is stored in the working memory 112. In the Step S9, the detection cycle count value AVC is incremented from "1" to "2". In the Step S10, it is determined whether or not the slitter blade units 4A to 4G have been entirely re-positioned. Until it is determined that the slitter blade units 4A to 4G have been entirely re-positioned, the processings in the Steps S5 to S10 will be repeated, wherein, in the Step S8, the current value CX is stored in the working memory 112 in correlated relation with a position incrementally displaced rearwardly by 10 mm per detection.

When it is determined that the slitter blade units 4A to 4G have been entirely re-positioned (S10: YES), the process advances to Step S11 in which the transverse movement servomotor group 129 starts to move all of the slitter blade units 4A to 4G frontwardly from respective ones of the rear end positions BPA to BPG illustrated in FIG. 5. In this step, the transverse movement servomotor group 129 is rotated at the given transverse movement rotational speed stored in the set value memory 113.

At Step S12, each of the current detection circuits 133A to 133G detects a drive current value CX of a respective one of the servomotors in the transverse movement servomotor group 129 during the frontward movement of the slitter blade units 4A to 4G.

In Step S13, with respect to each servomotor in the transverse movement servomotor group 129, it is determined whether or not the detected drive current value CX is equal to or greater than the current peak value CP. When the current value CX is determined to be not equal to or greater than the current peak value CP (S13: NO), the process skips to the Step S15. On the other hand, when the current value CX is determined to be equal to or greater than the current peak value CP (S13: YES), the process advances to the Step S14.

In the Step S14, with respect to each transverse movement servomotor, the detected drive current value CX is stored in the working memory 112 as an updated current peak value CP.

In Step S15, with respect to each transverse movement servomotor, the detected drive current value CX is stored in correlated relation with a corresponding one of the rear end positions. For example, as to the transverse movement servomotor 39 of the slitter blade unit 4E, the current value CX is stored in the working memory 112 in correlated relation with the rear end position BPA. Further, the current value CX is added to the accumulated current value CR, and a resulting accumulated current value CR is stored in the working memory 112.

In Step S16, the detection cycle count value AVC is incremented by "1". Specifically, in the Step S16, the number of detection cycles for detecting the current value CX is counted, and stored in the working memory 112.

In Step S17, based on a detection result of the transverse movement position detectors 118A to 118G, it is determined whether or not the seven slitter blade units 4A to 4G have been re-positioned at respective ones of the front end positions FPA to FPG illustrated in FIG. 5. When it is determined that the slitter blade units 4A to 4G have not been entirely re-positioned (S17: NO), the process returns to the Step S12 to execute the processing in the Step S12 again. When it is determined that the slitter blade units 4A to 4G have been entirely re-positioned (S17: NO), the process advances to the Step S18.

In Step S18, it is determined whether or not the current peak value CP is equal to or greater than the threshold SHP. When the current peak value CP is determined to be not equal to or greater than the threshold SHP (S18: NO), the process skips to Step S20. When the current peak value CP is determined to be equal to or greater than the threshold SHP (S18: YES), the process advances to Step S19 in which an error message is displayed on the display unit 130. Assuming that the current peak value CP of a specific one of the transverse movement servomotors is equal to or greater than the threshold SHP, unit information specifying one of the slitter blade units having the specific transverse movement servomotor, and range information specifying one of the moving ranges corresponding to the specified slitter blade unit, and a message indicating that a defect occurs in the specified moving rage of the specified slitter blade unit, are displayed as the error message. By looking at the error message, the inspection person can know in which of the slitter blade units and in which of the moving ranges a defect occurs. That is, from a content of the error message, the inspection person can know in which of the moving ranges MSA to MSG along the lower threaded shaft 12 a defect occurs. Generally, in the situation where the current peak value CP is equal to or greater than the threshold SHP, it is likely that a paper powder adheres onto the lower threaded shaft 12 at a position where the current peak value CP occurs, and, due to the adherence of the paper powder, a large load is applied to the transverse movement servomotor when it passes through a specific area of the lower threaded shaft 12.

Figure 7:
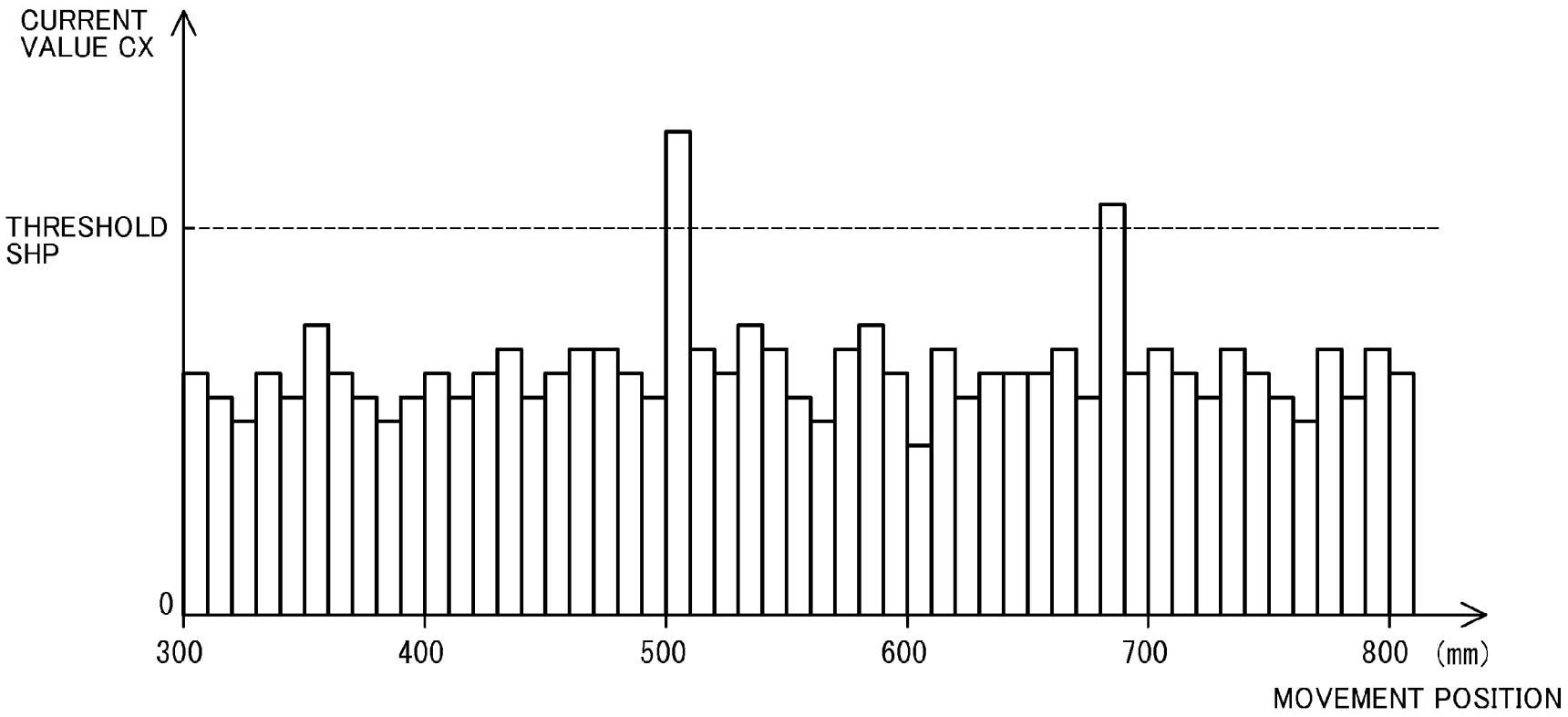
FIG. 7 is an explanatory graph illustrating a content of a relationship between a current value CX and a movement position of a slitter blade unit, to be displayed on a display unit.

In this embodiment, in the Steps S8 and S15, with respect to each transverse movement servomotor, the current value CX is stored in the working memory 112 in correlated relation with a movement position of the slitter blade unit every time the slitter blade unit is moved by a distance of 10 mm. Based on the correlation between the current value CX and the movement position, a movement position of the slitter blade unit causing a sharp increase in the current value CX can be displayed on the display unit 130 as an error message. For example, as illustrated in FIG. 7, a relationship between the current value CX and the movement position of the slitter blade unit is displayed on the display unit 130. Specifically, in a range of 300 to 800 mm measured from the front end side in the overall moving range TMS illustrated in FIG. 5, the current value CX is displayed in relation to the movement positions in units of 10 mm. In FIG. 7, the current value CX is sharply increased to become equal to or greater than the threshold SHP, around a movement position of 500 mm and around a movement position of 700 mm. Thus, the inspection person can readily know that a paper powder adheres onto the lower threaded shaft 12 in vicinities of the movement positions.

In Step S20, an average value CA of the current values CX is calculated by dividing the accumulated current value CR by the detection cycle count value AVC, and stored in the working memory 112.

In Step S21, it is determined whether or not the average value CA is equal to or greater than the average threshold SHA. When the average value CA is determined to be not equal to or greater than the average threshold SHA (S21: NO), the transverse movement inspection process is terminated. On the other hand, when the average value CA is determined to be equal to or greater than the average threshold SHA (S21: YES), the process advances to Step S22 in which an error message is displayed on the display unit 130. Assuming that the average value CA of a specific one of the transverse movement servomotors is equal to or greater than the average threshold SHA, unit information specifying one of the slitter blade units having the specific transverse movement servomotor is displayed as the error message. By looking at the error message, the inspection person can know in which of the slitter blade units a defect occurs. That is, the inspection person can know in which of the transverse movement servomotors or rotatable members of the slitter blade units a defect occurs.

The slitter blade receiver unit-related transverse movement inspection process is executed in the same manner as that in the slitter blade unit-related transverse movement inspection process. Thus, from a content of an error message displayed on the display unit 130, the inspection person can know in which of seven moving ranges along the upper threaded shaft 11 a defect occurs. Specifically, when the current value is sharply increased to become equal to or greater than the threshold SHP, information as illustrated in FIG. 7 is displayed on the display unit 13. Thus, the inspection person can readily know that a paper powder is likely to adhere onto the upper threaded shaft 11 around a position where the sharp increase in the current value occurs. Further, assuming that the average value of a specific one of the transverse movement servomotors is equal to or greater than the average threshold, unit information specifying one of the slitter blade units having the specific transverse movement servomotor is displayed on the display unit 130 as an error message. Thus, by looking at the error message, the inspection person can know in which of the transverse movement servomotors or rotatable members of the slitter blade receiver units a defect occurs.

(Change Rate Determination Process)

Figure 8:
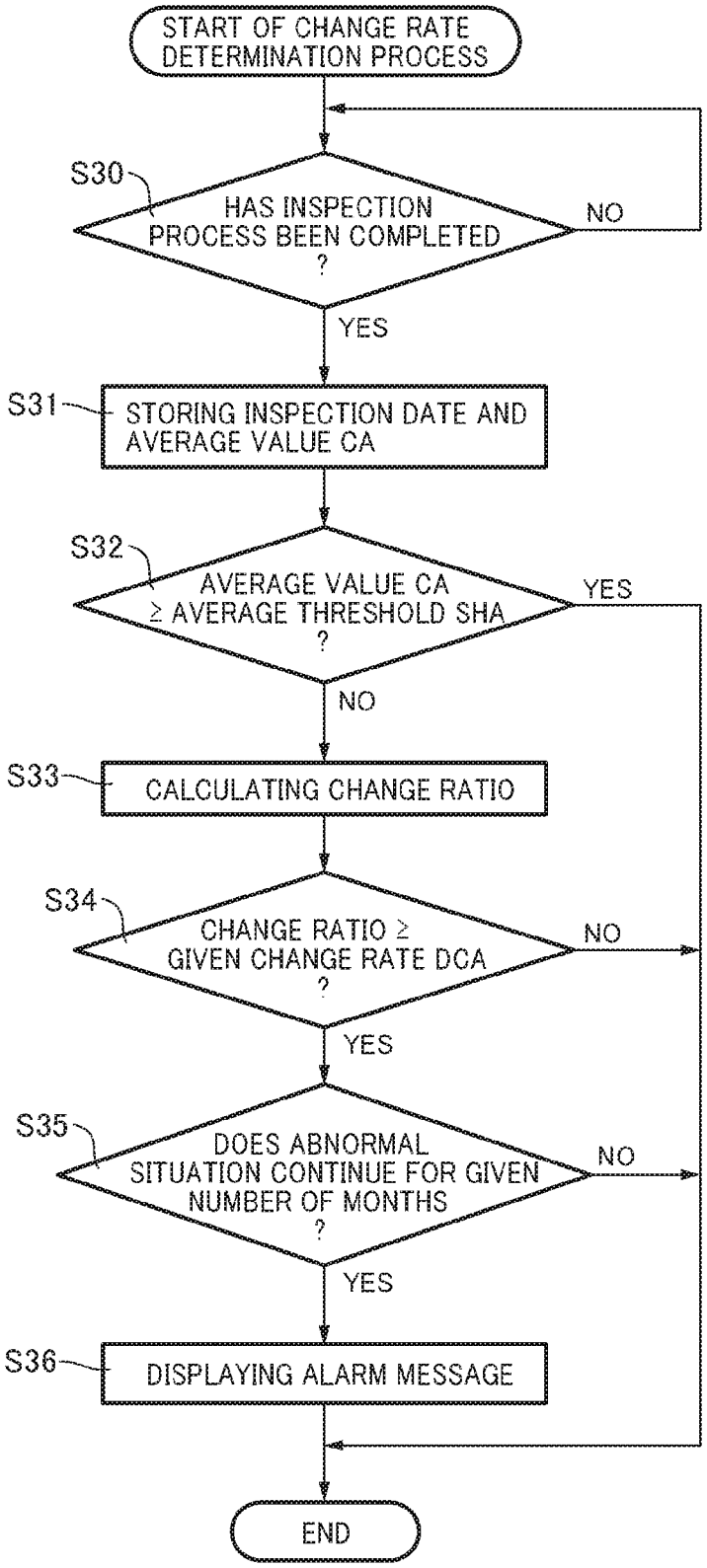
FIG. 8 is a flowchart illustrating a change rate determination process for determining a change rate between average drive current values CA calculated in the transverse movement inspection process to be execute on a monthly basis.

With reference to FIG. 8, the change rate determination process of determining a change rate of the average value CA calculated in Step S20 in the slitter blade unit-related transverse movement inspection process will be described.

The change rate determination process is a process for inspecting a possibility of the occurrence of a defect in each of the slitter blade units before a defect actually occurs in the slitter blade unit and the average value CA reaches the average threshold SHA. In response to manipulation of the inspection start key 115 by an inspection person, the slitter controller 110 stores a selected inspection mode in the working memory 112, and sets an operation mode to the inspection mode. When the inspection mode is set, the slitter controller 110 starts to run the change rate determination program stored in program memory 111. Along with the execution of the change rate determination program, the process illustrated in FIG. 8 will be executed. The process illustrated in FIG. 8 is executed by the slitter controller 110.

In Step S30, it is determined whether or not the transverse movement inspection process illustrated in FIG. 6 has been terminated. When it is determined that the transverse movement inspection process has not been terminated (S30: NO), the determination in Step S30 will be repeated. When it is determined that the transverse movement inspection process has been terminated (S30: YES), the process advances to Step S31.

In the Step S31, an execution date of the transverse movement inspection process and the average value CA calculated in the Step S20 are stored in the average value memory 116 in correlated relation with each other. Specifically, inspection date information indicative of date at the time of termination of the transverse movement inspection process is acquired from a timer clock of the slitter controller 110. Further, the average value CA temporarily stored in the working memory 112 in the Step S20 is read. The acquired inspection date information and the read average value CA are stored in the average value memory 116 in correlated relation with each other.

In Step S32, it is determined whether or not the average value CA calculated in the Step S20 is equal to or greater than the average threshold SHA. When the average value CA is determined to be equal to or greater than the average threshold SHA (S32: YES), the change rate determination process is terminated. That is, in a situation where the average value CA is equal to or greater than the average threshold SHA, a defect actually occurs. Thus, it is not necessary to execute the change rate determination process as a preliminary inspection before the occurrence of a defect.

In Step S33, a change rate between the average values CA is calculated. In this embodiment, the transverse movement inspection process is executed on a monthly basis, and thereby the average value memory 116 stores therein the average value CA on a monthly basis. The change rate is a difference obtained by subtracting a last month's average value CA from this month's average value CA. Generally, a frictional resistance between the threaded shaft and the nut portion of the rotatable member driven by each of the transverse movement servomotor will be gradually increased along with a progress of accumulation of a paper powder on the threaded shaft, decrease of lubricating oil, wear of a contact area or the like. Along with an increase in the frictional resistance, the drive current of each of the transverse movement servomotor will be gradually increased, and the average value CA will also be gradually increased.

In Step S34, it is determined whether or not the change rate calculated in the Step S33 is equal to or greater than the given change rate DCA. When the change rate is determined to be not equal to or greater than the given change rate DCA (S34: NO), the change rate determination process is terminated. On the other hand, when the change rate is determined to be equal to or greater than the given change rate DCA (S34: YES), the process advances to Step S35.

Figure 9:
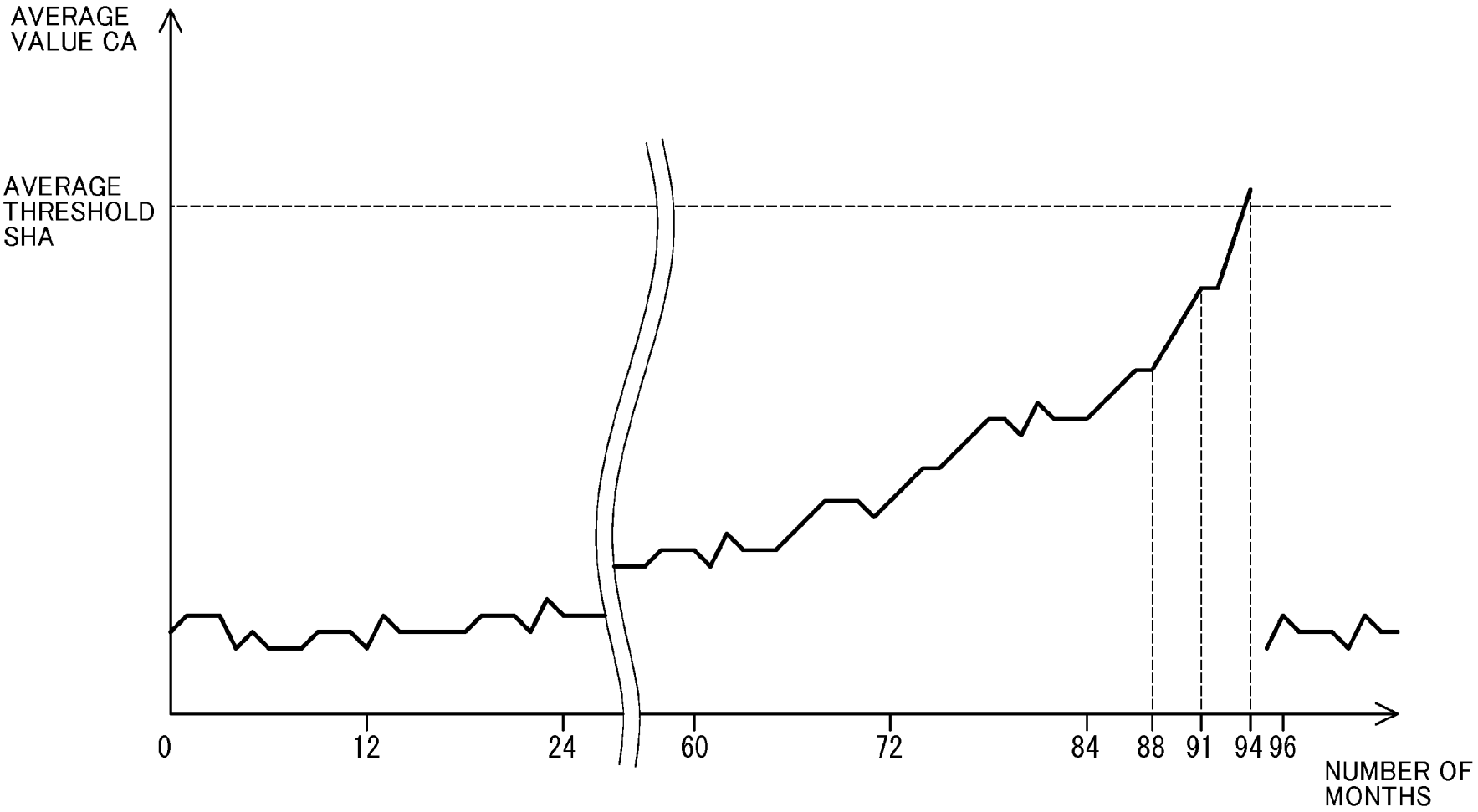
FIG. 9 is an explanatory graph illustrating a relationship between the number of elapsed months and a change in the average drive current value CA calculated in the transverse movement inspection process to be executed on a monthly basis.

Generally, along with progress in the accumulation of a paper powder, the lack of lubricating oil, the wear or the like in the nut portion of the rotatable member, the threaded shaft, a bearing of the servomotor, etc., a phenomenon becomes prominent that a large load is continuously applied to the servomotor. In an early stage of this phenomenon, the average value CA of the drive current of the servomotor is apt to increase continuously and be relatively large, although the average value CA never reaches the average threshold SHA. FIG. 9 illustrates a relationship between the number of elapsed months and a change in the average value CA calculated in the transverse movement inspection process to be performed on a monthly basis. In FIG. 9, the average value CA gradually increases along with an increase in the number of elapsed months. However, from the time of 72-nd month, the change rate between the average values CA becomes large. Then, for three consecutive months after 88-th month, the change rate between the average values CA becomes equal to or greater than the given change rate DCA. Subsequently, the average values CA sharply increases, and exceeds the average threshold SHA at the time of 92-nd month. In the transverse movement inspection process executed at the time of 94-th month, an error message is displayed on the display unit 130 in the Step S22. Thus, the inspection person performs a maintenance work for the defect. Therefore, after 95-th month, the average values CA returns to a normal value.

In Step S35, it is determined whether or not the situation where the change rate is equal to or greater than the given change rate DCA continues for a given number of months. In this embodiment, the given number of months is three months. When it is determined that the situation does not continues for the given number of months (S35: NO), the change rate determination process is terminated. On the other hand, when it is determined that the situation continues for the given number of months (S35: YES), the process advances to Step S36. For example, in FIG. 9, the change rate between the average values CA calculated in the transverse movement inspection process executed for three month from 88-th month to 91-st month is equal to or greater than the given change rate DCA for three consecutive months. Thus, in the Step S35, it is determined that the situation where the change rate is equal to or greater than the given change rate DCA continues for the given number of months.

In Step S36, an alarm message is displayed on the display unit 130. After completion of the processing in the Step S36, the change rate determination process is terminated. Assuming the change rate between the average values CA of a specific one of the transverse movement servomotors is equal to or greater than the given change rate DCA for the given number of consecutive months, unit information specifying one of the slitter blade units having the specific transverse movement servomotor, and an message indicating that a defect is likely to occur in the specified slitter blade unit, are displayed as the error message. By looking at the error message, the inspection person can know in which of the slitter blade units a defect is likely to occur. That is, the inspection person can know in which of the transverse movement servomotors or rotatable members of the slitter blade units a defect is likely to occur, and perform a maintenance work before the defect actually occurs.

The change rate determination process illustrated in FIG. 8 is configured to make a determination on the change rate between the average values CA calculated in the slitter blade unit-related transverse movement inspection process. The change rate determination process can also be applied to the change rate between the average values CA calculated in the slitter blade receiver unit-related transverse movement inspection process. Further, the change rate determination process illustrated in FIG. 8 can also be applied to the change rate between the average values CA calculated in the slitter blade-related up-down movement inspection process as described in detail later.

(Slitter Blade-Related Up-Down Movement Inspection Process)

Figure 10:
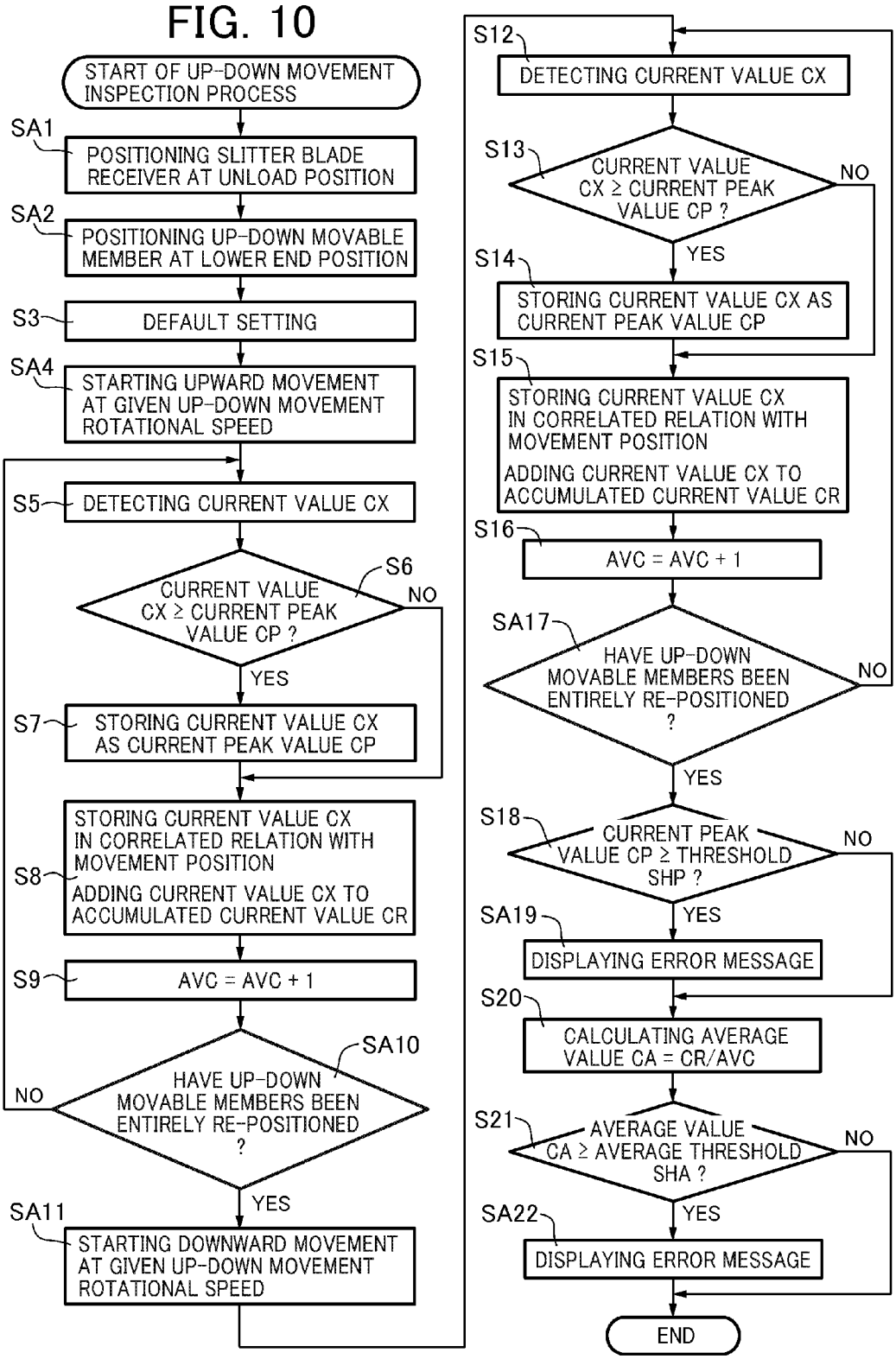
FIG. 10 is a flowchart illustrating a slitter up-down movement inspection process.

With reference to FIG. 10, the slitter blade-related up-down movement inspection process will be described. In FIG. 10, the same processing as that in the slitter blade unit-related transverse movement inspection process illustrated in FIG. 6 is assigned with the same code, and its description will be omitted.

In order to execute the up-down movement inspection process for the seven slitter blade units 4A to 4G, an inspection person manipulates the operation panel 114 so as to select the slitter blade up-down movement inspection mode. Then, the inspection person manipulates the inspection start key 115. In response to detecting the manipulation of the inspection start key 115, the slitter controller 110 stores the selected inspection mode in the working memory 112 and sets an operation mode to the inspection mode. When the inspection mode is set, the slitter controller 110 starts to run the slitter blade-related up-down movement inspection control program stored in program memory 111. After termination of the execution of the up-down movement inspection control program, the slitter controller 110 releases the inspection mode. During execution of the inspection mode, the slitter controller 110 inhibits an operation of manually moving the slitter blade receiver units and the slitter blade units. Along with the execution of the up-down movement inspection control program, the process illustrated in FIG. 10 will be executed. The process illustrated in FIG. 10 is executed by the slitter controller 110.

In Step SA1, the seven slitter blade receiving units 3A to 3G are positioned at the unload position according to action of the air cylinder group 121 including the air cylinder 29. All of the slitter blade receiving units are positioned at the unload position in the above manner. This makes it possible to prevent interference between the slitter blade and the slitter blade receiver, which would otherwise occur when the slitter blade is moved upwardly.

In Step SA2, based on a detection result of the up-down movement position detectors 119A to 119G, the seven up-down movable members of the slitter blade units 4A to 4G are moved and positioned, respectively, at given lower end positions defined on the seven vertical threaded shafts including the vertical threaded shaft 46, by the up-down movement servomotor group 126 including the up-down movement servomotor 47. Then, in Step S3, a default setting is executed as mentioned above.

In Step SA4, the up-down movement servomotor group 126 starts to move the up-down movable members of the slitter blade units 4A to 4G upwardly from respective ones of the lower end positions. In this step, the up-down servomotor group 126 is rotated at the given up-down movement rotational speed stored in the set value memory 113. During the upward movement, processings in Steps S5 to S9 are executed as mentioned above to store the current value CX and add the current value CX to the accumulated current value CR.

In Step SA10, based on a detection result of the up-down movement position detectors 119A to 119G, it is determined whether or not the seven up-down movable members of the slitter blade units 4A to 4G have been re-positioned, respectively, at given upper end positions defined on the seven vertical threaded shafts including the vertical threaded shaft 46. When the up-down movable members of the slitter blade units 4A to 4G have not been entirely re-positioned (SA10: NO), the process returns to the Step S5 to execute the processing in the Step S5 again. On the other hand, when the up-down movable members of the slitter blade units 4A to 4G have been entirely re-positioned (SA10: YES), the process advances to Step SA11.

In the Step SA11, the up-down movement servomotor group 126 starts to move all of the up-down movable members of the slitter blade units 4A to 4G downwardly from respective ones of the upper end positions. In this step, the up-down movement servomotor group 126 is rotated at the given up-down movement rotational speed stored in the set value memory 113. Processings in Steps S12 to S16 are executed as mentioned above to store the current value CX and add the current value CX to the accumulated current value CR.

In Step SA17, based on a detection result of the up-down movement position detectors 119A to 119G, it is determined whether or not the seven up-down movable members of the slitter blade units 4A to 4G have been re-positioned at respective ones of the lower end positions. When it is determined that the seven up-down movable members of the slitter blade units 4A to 4G have not been entirely re-positioned (SA17: NO), the process returns to the Step S12 to execute the processing in the Step S12 again. When it is determined that the seven up-down movable members of the slitter blade units 4A to 4G have been entirely re-positioned (SA17: YES), the process advances to Step S18.

When the current peak value CP is determined to be equal to or greater than the threshold SHP (S18: YES), an error message is displayed on the display unit 130 in Step SA19. Assuming that the current peak value CP of a specific one of the transverse movement servomotors is equal to or greater than the threshold SHP, unit information specifying one of the slitter blade units having the specific transverse movement servomotor, and position information specifying a defective position of the vertical threaded shaft of the specified slitter blade unit, are displayed as the error message.

In this embodiment, in the Steps S8 and S15, with respect to each up-down movement servomotor, the current value CX is stored in the working memory 112 in correlated relation with an up-down movement position of the up-down movable member every time the up-down movable member is moved by a distance of 10 mm. Based on the correlation between the current value CX and the up-down movement position, an up-down movement position of the up-down movable member causing a sharp increase in the current value CX can be displayed on the display unit 130 as an error message. In accordance with the error message on the display unit 130, the inspection person can readily know that a paper powder is likely to adhere onto the vertical threaded shaft in vicinities of the up-down movement position where the current value CX is sharply increased.

When the average value CA is determined to be equal to or greater than the average threshold SHA (S21: YES), an error message is displayed on the display unit 130 in Step S22. Assuming that the average value CA of a specific one of the transverse movement servomotors is equal to or greater than the average threshold SHA, unit information specifying one of the slitter blade units having the specific transverse movement servomotor is displayed as the error message. By looking at the error message, the inspection person can know in which of the slitter blade units a defect occurs. That is, the inspection person can know in which of the transverse movement servomotors or rotatable members of the slitter blade units a defect occurs.

Effects of this Embodiment

In this embodiment, the current detection circuits 131A to 131G, 133A to 133G, the current detection circuit 132A to 132G, the transverse movement drive circuits 123, 128, and the up-down movement drive circuit 125 are electrically connected together. This makes it possible to eliminate a need for performing installation operations while taking into account a positional relationship with the slitter blade receiver 30 and the slitter blade 50, thereby inspecting a defect of each of the rotatable members and the up-down movable members or a defect of the threaded shafts, with a simple configuration.

In this embodiment, in the transverse movement inspection process, the display unit 130 displays, as an error message, unit information specifying a defective one of the slitter blade receiver units or slitter blade units, and range information specifying a defective one of the moving ranges corresponding to the defective unit. Thus, an inspection person can readily know a defective unit from a large number of units, and reliably know a defective moving range on the threaded shafts 11, 12. Further, the display unit 130 displays, as an error message, information specifying a movement position of each unit where the current value CX is sharply increased. Thus, the inspection operator can particularly know that a defect occurs at a movement position displayed in a specified moving range on the threaded shaft 11 or 12, and perform a maintenance/inspection work quickly and reliably. Similarly, in the up-down movement inspection process, the display unit 130 displays, as an error message, unit information specifying a defective one of the slitter blade units, and information specifying a movement position of each unit where the current value CX is sharply increased. Thus, an inspection person can readily know a defective slitter blade unit from a large number of slitter blade units, and particularly know that a defect occurs at a movement position displayed on the vertical threaded shaft of the defective unit, thereby performing a maintenance/inspection work quickly and reliably.

In this embodiment, in the transverse movement inspection process and the up-down movement inspection process, each of the transverse movement servomotors 24, 39 and the up-down movement servomotors 47 is rotated at a given rotational speed which is less than a rotational speed to be set during machining to move a respective one of the rotatable members 26, 41 and the up-down movable members 48 so as to cut a corrugated paperboard. In this embodiment, the given rotational speed is set to be less than the rotational speed during machining by about 30% thereof. This makes it possible to prevent a load greater than that during cutting from being imposed on each servomotor in the transverse movement inspection process and the up-down movement inspection process, thereby minimizing noise and vibration in the entire slitter 1 even if a large number of units are simultaneously moved. Further, each of the threshold SHP and the average threshold SHA is set to a value which is less than the drive current of each servomotor supplied when the servomotor is normally rotated at a given rotational speed. Thus, in the inspection process, a defect of each servomotor can be accurately inspected by setting the rotational speed of the servomotor to the given rotational speed.

In this embodiment, when, in the Step S34, the change rate between the average values CA of the drive current is determined to be equal to or greater than the given change rate DCA, and, in Step S35, the change rate between the average values CA is determined to be equal to or greater than the given change rate DCA for a given number of consecutive months, an alarm is issued which indicates that a defect is likely to occur in the rotatable member, the up-down movable member, threaded shaft or the servomotor. Thus, by looking at an error message on the display unit 130, a user can preliminarily perform a maintenance work for preventing the occurrence of a defect.

Correspondence Between this Embodiment and Claims

The slitter 1 is one example of "corrugated paperboard machine" set forth in the appended claims, and each of the slitter blade receiver 30 and the slitter blade 50 is one example of "machining tool" set forth in the appended claims. Each of the rotatable members 26, 41, the up-down movable member 48 and the nut portion 55 is one example of "movable member" set forth in the appended claims, and the nut portion is one example of "nut portion" set forth in the appended claims. Each of the threaded shafts 11, 12, 46 is one example of "support member" set forth in the appended claims. Each of the transverse movement servomotors 24, 39 and the up-down movement servomotor 47 is one example of "drive motor" set forth in the appended claims. Each of the moving ranges MSA to MSG is one example of "moving range" set forth in the appended claims, and each the front end positions FPA to FPG is one example of "initial position" set forth in the appended claims. The slitter controller 110 capable of executing the processing in Step S2 is one example of "position setting section" set forth in the appended claims. The slitter controller 110 capable of executing the processing in Step S11 is one example of "control section" set forth in the appended claims. Each of the current detection circuits 131A to 131G 132A to 132G 133A to 133G, is one example of "current detection section" set forth in the appended claims. The slitter controller 110 capable of executing the processing in Step S18 is one example of "current determination section" set forth in the appended claims. The processing in the Step S8 and the working memory 112 are one example of "current value storage section" set forth in the appended claims. The slitter controller 110 capable of executing the processing in Step S20 is one example of "average value calculation section" set forth in the appended claims, and the slitter controller 110 capable of executing the processing in Step S21 is one example of "average value determination section" set forth in the appended claims. The slitter controller 110 capable of executing the processings in Steps S18 and S21 is one example of "defect detection section" set forth in the appended claims. The display unit 130 is one example of "defect informing section" and "position informing section" set forth in the appended claims. Each of the inspection start key 115 and the slitter controller 110 capable of detecting the manipulation of the inspection start key 115 is one example of "mode setting section" set forth in the appended claims. The average value memory 116 is one example of "average value storage section" set forth in the appended claims. The slitter controller 110 capable of executing the processings in Steps S34 and S35 is one example of "change rate determination section" set forth in the appended claims. A plurality of sets of the up-down movable member 48, the vertical threaded shaft 46, the up-down movement servomotor 47, in the slitter blade units 4A to 4G, are one example of "plurality of tool moving mechanisms" set forth in the appended claims.

Modifications

Although the present invention has been fully described by way of example with reference to the accompanying drawings, it is obvious to those skilled in the art that various changes and modifications may be made therein without departing from the spirit and scope thereof as set forth in the appended claims.

(1) In the above embodiment, one tool moving mechanism of the slitter 1 is configured to move the slitter blade units 4A to 4G transversely by the transverse movement servomotor group 129, while allowing the nut portions of the seven rotatable members of the slitter blade units 4A to 4G to be threadingly engaged with the one threaded shaft 12. However, the present invention is not limited to this configuration. For example, a tool moving mechanism of a Blotter for subjecting a corrugated paperboard sheet to slotting may be configured to move a machining tool transversely by a plurality of transverse movement servomotors, while allowing a plurality of holders supporting the machining tool to be slidingly moved on one guide shaft. Specifically, a linear motion mechanism adapted to guide a holder by utilizing "rolling", such as an LM guide (trademark) produced by THK Co., Ltd., may be employed. Further, instead of the mechanism in which a threaded shaft and a nut shaft are threadingly engaged with each other, a mechanism may be employed in which one rack is meshingly with a pinion supported by each of a plurality of rotatable members and adapted to be rotated by a transverse movement servomotor.

(2) In the above embodiment, each of the seven tool moving mechanisms of the slitter 1 is configured to move each of the seven up-down movable members of the slitter blade units 4A to 4G upwardly and downwardly by the up-down movement servomotor group 126, while allowing the nut portion of the rotatable member in each of the slitter blade units 4A to 4G to be threadingly engaged with a respective one of the seven vertical threaded shafts. However, the present invention is not limited to this configuration. For example, in a corrugating machine, a plurality of tool moving mechanisms may comprise a tool moving mechanism provided in a slitter, and a tool moving mechanism provided in a scorer. In this case, a management unit for managing a general operation of the corrugating machine controls an inspection process. Alternatively, in a box making machine, a plurality of tool moving mechanisms may comprise a tool moving mechanism provided in a slotter, a tool moving mechanism provided in a creaser, a handling tool moving mechanism provided in a counter ejector. In this case, a management unit for managing a general operation of the box making machine controls an inspection process. The handling tool moving mechanism of the counter ejector is configured to move a ledge or a correction plate for dividing a stack of machined corrugated paperboard sheets into a plurality of batches, or aligning edges of the sheets.

(3) In the above embodiment, the slitter controller is configured to execute the slitter blade unit-related transverse movement inspection process and the slitter blade receiver unit-related transverse movement inspection process, separately. Alternatively, the slitter controller may be configured to simultaneously execute the two transverse movement inspection processes.

(4) In the above embodiment, the slitter controller is configured to display an error message on the display unit 130 when the current peak value CP or the average value CA is determined to be equal to or greater than the threshold SHP or the average threshold SHA, in the Step S19 or the Step S22. However, the present invention is not limited to this configuration. The slitter controller may be configured to, when a defect of the rotatable member or the threaded shaft of the slitter blade unit is detected, automatically perform a measure for solving the defect. For example, the slitter controller may be configured to automatically supply lubricating oil around the defective rotatable member or threaded shaft. Such an automatic oil supply device is conventionally known, as disclosed, for example, in JP 08-247386A and JP 2000-304193A.

(5) In the above embodiment, the program memory 111 is configured to fixedly pre-store therein the slitter blade receiver unit-related transverse movement inspection control program, the slitter blade unit-related transverse movement inspection control program, a change rate determination program, and the up-down movement inspection control program, together with the machining control program for controlling a machining operation of the slitter 1. Alternatively, when a required inspection process is executed, various inspection control programs may be downloaded from an external server to the working memory vie the Internet. In the above embodiment, the slitter 1 is equipped with the display unit 130. However, the present invention is not limited to this configuration. For example, in cases where the slitter controller is installed in a corrugated paperboard manufacturing plant, and connected to a communication terminal in a remote location via the Internet, the slitter controller may be configured to allow an inspection person in a remote location to access thereto from the communication terminal to download information about an inspection result stored in the working memory so as to display the inspection result on a display unit of the communication terminal. In the above embodiment, the set value memory 113 is configured to fixedly pre-store therein various set values. However, the present invention is not limited to this configuration. For example, the slitter controller may be configured to transmit model information specifying type or model of a corrugated paperboard machine equipped with the slitter controller, to an external server via the Internet, and download various set values unique to the model, from the external server to the working memory.

(6) In the above embodiment, the slitter controller is configured to, when the situation where the change rate between the average values CA calculated in the Step S20 is equal to or greater than the given change rate DCA continues for the given number of months, display an alarm message on the display unit 130. However, the present invention is not limited to the configuration based on the condition that the situation continues for the given number of months. For example, the slitter controller may be configured to display an alarm message when an amount of increase (per unit time period) of a newly calculated average value CA with respect to a previously calculated average value CA is equal to or greater than the given change rate DCA.

EXPLANATION OF REFERENCE NUMERALS

1: slitter
3A to 3G: slitter blade receiver unit
4A to 4G: slitter blade unit
30: slitter blade receiver
11, 12, 46: threaded shaft
24, 39: transverse movement servomotor
26, 41: rotatable member
47: up-down movement servomotor
48: up-down movable member
50: slitter blade
55: nut portion
112: working memory
115: inspection start key
116: average value memory
130: display unit
131A to 131G, 132A to 132G 133A to 133G: current detection circuits
110: slitter controller
FD: conveyance direction
MSA to MSG: moving range
FPA to FPG: front end position
CX: current value
CA: average of current calves CX
SHP: threshold
SHA: average threshold

What is claimed is:

1. An automatic inspection device for a corrugated paperboard machine having a tool moving mechanism, the tool moving mechanism comprising a plurality of movable members each coupled to a respective one of a plurality of machining tools for subjecting a corrugated paperboard to machining; a support member movably supporting the plurality of movable members; and a plurality of drive motors for moving respective ones of the plurality of movable members along the support member, the automatic inspection device comprising:

a position setting section for setting the plurality of movable members to positions located within a plurality of ranges of motion, wherein each range of motion is defined along the support member, each moving member corresponding to a respective one of the plurality of movable members;

a control section for driving each of the plurality of drive motors at a given rotational speed so as to allow a respective one of the plurality of movable members to be moved within a corresponding one of the plurality of ranges of motion;

a current detection section for detecting a drive current being supplied to each of the plurality of drive motors when each of the plurality of drive motors is driven at the given rotational speed by the control section;

a current determination section for determining whether or not the drive current of each of the plurality of drive motors detected by the current detection section exceeds a given threshold; and a defect detection section configured to detect that a defect, caused by paper powder scattered and accumulated during cutting a corrugated paperboard, occurs in the movable member driven by a specific one of the plurality of drive motors, or in a portion of the support member corresponding to the range of motion of the movable member driven by the specific one of the plurality of drive motors, the defect detection section being configured to detect said defect based exclusively on a determination of the current determination section, that the drive current of the specific one of the plurality of drive motors exceeds the given threshold;

wherein the plurality of ranges of motion are defined along the support member in adjacent relation to each other;

the position setting section is operable to position each of the plurality of movable members at its initial position defined in a vicinity of an end position of a corresponding one of the plurality of ranges of motion in a given direction along the support member; and the control section is operable to drive the plurality of drive motors so as to allow the plurality of movable members to be moved individually from their initial positions in a same direction;

wherein the automatic inspection device further comprises a current value storage section for, during a course where the plurality of movable members are moved individually from their initial positions in the same direction, sequentially storing a value of the drive current of each of the plurality of drive motors detected by the current detection section, in correlated relation with a position of the movable member moved by each of the plurality of drive motors.

2. The automatic inspection device according to claim 1, which further comprises a defect informing section for, when the defect detection section detects the defect, informing that a defect occurs in the movable member driven by the one of the plurality of drive motors whose drive current is determined to exceed the given threshold by the current determination section, or in a portion of the support member corresponding to the range of motion of the movable member driven by the one of the plurality of drive motors.

3. The automatic inspection device according to claim 1, which further comprises a position informing section for, based on a content stored in the current value storage section, informing of a position of the movable member driven by the one of the plurality of drive motors when the drive current of the one of the plurality of drive motors exceeds the given threshold.

4. The automatic inspection device according to claim 1, which further comprises:

an average value calculation section for calculating an average of values of the drive current detected by the current detection section during a course where each of the plurality of movable members is moved across an entirety of a corresponding one of the ranges of motion; and an average value determination section for determining whether or not the average value calculated by the average value calculation section with regard to each of the plurality of drive motors exceeds a given average threshold, wherein the automatic inspection device is configured to, when the average value determination section determines that the average value of one of the plurality of drive motors exceeds the given average threshold, detect that a defect occurs in the movable member driven by the one of the plurality of drive motors.

5. The automatic inspection device according to claim 4, wherein:

the current detection section is operable to perform the operation of detecting a drive current being supplied to each of the plurality of drive motors, at a plurality of different inspection timings; and the average value calculation section is operable to calculate an average of values of the drive current detected by the current detection section, at each of the plurality of different inspection timings, and wherein the automatic inspection device comprises:

an average value storage section for storing a historical data set after each inspection, wherein the historical data set includes an average of values of the drive current and a time stamp corresponding to an inspection timing; and a change rate determination section for determining whether or not a change rate between the average of values stored in the average value storage section exceeds a given change rate, and wherein the automatic inspection device is configured to, when the change rate determination section determines that the change rate between the stored average values of one of the plurality of drive motors exceeds the given change rate, detect that a defect occurs in the movable member driven by the one of the plurality of drive motors.

6. The automatic inspection device according to claim 1, wherein:

each of the plurality of machining tools is a machining tool for cutting a corrugated paperboard;

the support member comprises a threaded shaft extending across a conveyance direction of the corrugated paperboard; and each of the plurality of movable members comprises a nut member threadingly engaged with the threaded shaft.

7. The automatic inspection device according to claim 1, wherein the control section is operable to drive each of the plurality of drive motors at a given rotational speed being imposed on all of the drive motors during the inspections, which value is less than a nominal rotational speed used during machining of a corrugated paperboard.

8. A corrugated paperboard machine comprising:

a plurality of machining tools for subjecting a corrugated paperboard to machining;

a tool moving mechanism including a plurality of movable members each coupled to a respective one of the plurality of machining tools, a support member movably supporting the plurality of movable members, and a plurality of drive motors for moving respective ones of the plurality of movable members along the support member;

a mode setting section for setting an inspection mode;

a position setting section for, when the inspection mode is set, setting the plurality of movable members to positions located within a plurality of ranges of motion, each range of motion being defined along the support member, each moving member corresponding to a respective one of the plurality of movable members;

a control section for, when the inspection mode is set, driving each of the plurality of drive motors at a given rotational speed so as to allow a respective one of the plurality of movable members to be moved within a corresponding one of the plurality of ranges of motion;

a current detection section for detecting a drive current being supplied to each of the plurality of drive motors when each of the plurality of drive motors is driven at the given rotational speed by the control section;

a current determination section for determining whether or not the drive current of each of the plurality of drive motors detected by the current detection section exceeds a given threshold; and a defect detection section configured to detect that a defect, caused by paper powder scattered and accumulated during cutting a corrugated paperboard, occurs in the movable member driven by a specific one of the plurality of drive motors, or in a portion of the support member corresponding to the range of motion of the movable member driven by the specific one of the plurality of drive motors, the defect detection section being configured to detect said defect based exclusively on a determination of the current determination section, that the drive current of the specific one of the plurality of drive motors exceeds the given threshold;

wherein the plurality of ranges of motion are defined along the support member in adjacent relation to each other;

the position setting section is operable to position each of the plurality of movable members at its initial position defined in a vicinity of an end position of a corresponding one of the plurality of ranges of motion in a given direction along the support member; and the control section is operable to drive the plurality of drive motors so as to allow the plurality of movable members to be moved individually from their initial positions in a same direction;

wherein the automatic inspection device further comprises a current value storage section for, during a course where the plurality of movable members are moved individually from their initial positions in the same direction, sequentially storing a value of the drive current of each of the plurality of drive motors detected by the current detection section, in correlated relation with a position of the movable member moved by each of the plurality of drive motors.

9. An automatic inspection device for a corrugated paperboard machine having a plurality of tool moving mechanisms, each of the tool moving mechanisms comprising a movable member coupled to a tool for subjecting a corrugated paperboard to machining or operation; a support member movably supporting the movable member; and a drive motor for moving either one of the movable member and support member so as to move the movable member along the support member, the automatic inspection device comprising:

a control section for driving the drive motor in each of the plurality of tool moving mechanisms, at a given rotational speed;

a current detection section for detecting a drive current being supplied to each of the drive motors in the plurality of tool moving mechanisms when said drive motor is driven at the given rotational speed by the control section;

a current determination section for determining whether or not the drive current of each of the drive motors detected by the current detection section exceeds a given threshold; and a defect detection section configured to detect that a defect, caused by paper powder scattered and accumulated during cutting a corrugated paperboard, occurs in the movable member driven by one of the drive motors, or in the support member supporting the movable member driven by the one of the drive motors, the defect detection section being configured to detect said defect based exclusively on a determination of the current determination section, that the drive current of the one of the drive motors exceeds the given threshold;

wherein the plurality of ranges of motion are defined along the support member in adjacent relation to each other;

the position setting section is operable to position each of the plurality of movable members at its initial position defined in a vicinity of an end position of a corresponding one of the plurality of ranges of motion in a given direction along the support member; and the control section is operable to drive the plurality of drive motors so as to allow the plurality of movable members to be moved individually from their initial positions in a same direction;

wherein the automatic inspection device further comprises a current value storage section for, during a course where the plurality of movable members are moved individually from their initial positions in the same direction, sequentially storing a value of the drive current of each of the plurality of drive motors detected by the current detection section, in correlated relation with a position of the movable member moved by each of the plurality of drive motors.

* * * * *